US008802880B1

(12) United States Patent
Adam et al.

(10) Patent No.: US 8,802,880 B1
(45) Date of Patent: Aug. 12, 2014

(54) CHROMATOGRAPHIC PROCESS FOR THE PRODUCTION OF HIGHLY PURIFIED POLYUNSATURATED FATTY ACIDS

(71) Applicant: Groupe Novasep SAS, Pompey (FR)

(72) Inventors: Philippe Adam, Maxéville (FR); Eric Valéry, Saulxures les Nancy (FR); Jean Bléhaut, Nancy (FR)

(73) Assignee: Group Novasep, Pompey (FR)

( * ) Notice: Subject to any disclaimer, the term of this patent is extended or adjusted under 35 U.S.C. 154(b) by 0 days.

(21) Appl. No.: 13/897,056

(22) Filed: May 17, 2013

Related U.S. Application Data

(60) Provisional application No. 61/820,459, filed on May 7, 2013.

(51) Int. Cl.
*C11B 3/00* (2006.01)

(52) U.S. Cl.
USPC ..... 554/193; 554/191; 554/224

(58) Field of Classification Search
USPC ..... 554/191, 193, 224
See application file for complete search history.

(56) References Cited

U.S. PATENT DOCUMENTS

| | | | |
|---|---|---|---|
| 2,985,589 | A | 5/1961 | Broughton et al. |
| 3,696,107 | A | 10/1972 | Neuzil |
| 3,706,812 | A | 12/1972 | deRosset et al. |
| 3,761,533 | A | 9/1973 | Otani et al. |
| 4,036,745 | A | 7/1977 | Broughton |
| 4,048,111 | A | 9/1977 | Rosback et al. |
| 4,048,205 | A | 9/1977 | Neuzil et al. |
| 4,049,688 | A | 9/1977 | Neuzil et al. |
| 4,189,442 | A | 2/1980 | Lubsen et al. |
| 4,313,015 | A | 1/1982 | Broughton |
| 4,329,280 | A | 5/1982 | Cleary et al. |
| 4,353,838 | A | 10/1982 | Cleary et al. |

(Continued)

FOREIGN PATENT DOCUMENTS

| | | | |
|---|---|---|---|
| DK | 1338316 | T3 | 3/2005 |
| DK | 1128881 | T3 | 10/2005 |

(Continued)

OTHER PUBLICATIONS

Beebe, Janet M., et al., "Analytical-Scale High-Performance Liquid Chromatography of Omega-3 Fatty Acid Esters Derived From Fish Oils," Journal of Chromatography, vol. 468, pp. 225-233 (1989).

(Continued)

*Primary Examiner* — Deborah D Carr
(74) *Attorney, Agent, or Firm* — Harness, Dickey & Pierce, P.L.C.

(57) ABSTRACT

A process is provided for recovering a first polyunsaturated fatty acid (PUFA) from a feed mixture including at least one additional fatty acid (e.g., a second fatty acid (FA)). The process optionally comprises:

performing a main step of chromatographic separation using an aqueous organic eluent and collecting a first stream of eluent enriched in the first PUFA and a second stream of eluent enriched in the second FA;

subjecting the second stream of eluent to a concentration step to obtain a concentrated portion including the second FA, and a depleted portion comprising eluent, but depleted of the second FA. The water-to-organic ratio of the depleted portion is lower than the water-to-organic ratio of the second stream of eluent. The process also includes:

at least partially recycling the depleted portion for use in the main step of chromatographic separation.

17 Claims, 7 Drawing Sheets

(56) References Cited

U.S. PATENT DOCUMENTS

| | | | |
|---|---|---|---|
| 4,353,839 | A | 10/1982 | Cleary et al. |
| 4,404,145 | A | 9/1983 | Cleary et al. |
| 4,433,195 | A | 2/1984 | Kulprathipanja |
| 4,486,618 | A | 12/1984 | Kulprathipanja et al. |
| 4,495,106 | A | 1/1985 | Cleary et al. |
| 4,511,514 | A | 4/1985 | Cleary et al. |
| 4,519,952 | A | 5/1985 | Cleary et al. |
| 4,521,343 | A | 6/1985 | Chao et al. |
| 4,522,761 | A | 6/1985 | Cleary et al. |
| 4,524,029 | A | 6/1985 | Cleary et al. |
| 4,524,030 | A | 6/1985 | Cleary et al. |
| 4,529,551 | A | 7/1985 | Cleary et al. |
| 4,560,675 | A | 12/1985 | Cleary et al. |
| 4,605,783 | A | 8/1986 | Zinnen |
| 4,720,579 | A | 1/1988 | Kulprathipanja |
| 4,764,276 | A | 8/1988 | Berry et al. |
| 4,797,233 | A | 1/1989 | Zinnen |
| 4,882,065 | A | 11/1989 | Barder |
| 4,902,829 | A | 2/1990 | Kulprtahipanja |
| 4,961,881 | A | 10/1990 | Ou |
| 5,064,539 | A | 11/1991 | Tanimura et al. |
| 5,068,418 | A | 11/1991 | Kulprathipanja et al. |
| 5,068,419 | A | 11/1991 | Kulprathipanja et al. |
| 5,069,883 | A | 12/1991 | Matonte |
| 5,093,004 | A | 3/1992 | Hotier et al. |
| 5,102,553 | A | 4/1992 | Kearney et al. |
| 5,114,590 | A | 5/1992 | Hotier et al. |
| 5,179,219 | A | 1/1993 | Priegnitz |
| 5,225,580 | A | 7/1993 | Zinnen |
| 5,422,007 | A | 6/1995 | Nicoud et al. |
| 5,502,077 | A | 3/1996 | Breivik et al. |
| 5,547,580 | A | 8/1996 | Tsujii et al. |
| 5,630,943 | A | 5/1997 | Grill |
| 5,656,667 | A | 8/1997 | Breivik et al. |
| 5,698,594 | A | 12/1997 | Breivik et al. |
| 5,719,302 | A | 2/1998 | Perrut et al. |
| 5,777,141 | A | 7/1998 | Brunner et al. |
| 5,790,181 | A | 8/1998 | Chahl et al. |
| 5,840,181 | A | 11/1998 | Patton et al. |
| 5,917,068 | A | 6/1999 | Barnicki et al. |
| 5,945,318 | A | 8/1999 | Breivik et al. |
| 6,013,186 | A | 1/2000 | Patton et al. |
| 6,063,284 | A | 5/2000 | Grill |
| 6,096,218 | A | 8/2000 | Hauck et al. |
| 6,136,198 | A | 10/2000 | Adam et al. |
| 6,204,401 | B1 | 3/2001 | Perrut et al. |
| 6,306,306 | B1 | 10/2001 | Voigt et al. |
| 6,313,330 | B1 | 11/2001 | Kiyohara et al. |
| 6,325,898 | B1 | 12/2001 | Blehaut et al. |
| 6,350,890 | B1 | 2/2002 | Kiy et al. |
| 6,375,839 | B1 | 4/2002 | Adam et al. |
| 6,409,923 | B1 | 6/2002 | Nicoud et al. |
| 6,413,419 | B1 | 7/2002 | Adam et al. |
| 6,471,870 | B1 | 10/2002 | Nicoud et al. |
| 6,518,049 | B1 | 2/2003 | Haraldsson et al. |
| 6,544,413 | B1 | 4/2003 | Nagamatsu et al. |
| 6,675,839 | B1 | 1/2004 | Braithwaite |
| 6,712,973 | B2 | 3/2004 | Adam et al. |
| 6,713,447 | B2 | 3/2004 | Beaudoin et al. |
| 6,740,243 | B2 | 5/2004 | Wankat |
| 6,789,502 | B2 | 9/2004 | Hjaltason et al. |
| 6,863,824 | B2 | 3/2005 | Hamende et al. |
| 6,979,402 | B1 | 12/2005 | Sprague et al. |
| 7,063,855 | B2 | 6/2006 | Hjaltason et al. |
| 7,462,643 | B1 | 12/2008 | Pamparana |
| 7,479,228 | B2 | 1/2009 | Schramm et al. |
| 7,491,522 | B2 | 2/2009 | Haraldsson et al. |
| 7,541,480 | B2 | 6/2009 | Bruzzese |
| 7,588,791 | B2 | 9/2009 | Fabritius |
| 7,667,061 | B2 | 2/2010 | Binder et al. |
| 7,678,930 | B2 | 3/2010 | Sondbø et al. |
| 7,705,170 | B2 | 4/2010 | Geier et al. |
| 7,709,236 | B2 | 5/2010 | Akimoto et al. |
| 7,718,698 | B2 | 5/2010 | Breivik et al. |
| 7,732,488 | B2 | 6/2010 | Breivik et al. |
| 7,807,848 | B2 | 10/2010 | Wang |
| 7,901,581 | B2 | 3/2011 | Bryntesson et al. |
| 8,063,235 | B2 | 11/2011 | Krumbholz et al. |
| 8,216,475 | B2 | 7/2012 | Valery et al. |
| 8,282,831 | B2 | 10/2012 | Kessler et al. |
| 2002/0011445 | A1 | 1/2002 | Lehoucq et al. |
| 2002/0068833 | A1 | 6/2002 | Chanteloup et al. |
| 2002/0174769 | A1 | 11/2002 | Adam et al. |
| 2003/0006191 | A1 | 1/2003 | Heikkila et al. |
| 2003/0216543 | A1 | 11/2003 | Wang et al. |
| 2003/0222024 | A1 | 12/2003 | Hamende et al. |
| 2004/0099604 | A1 | 5/2004 | Hauck et al. |
| 2005/0087494 | A1 | 4/2005 | Hauck et al. |
| 2005/0245405 | A1 | 11/2005 | Geier et al. |
| 2006/0008667 | A1 | 1/2006 | Kim et al. |
| 2006/0086667 | A1 | 4/2006 | Hauck et al. |
| 2006/0124549 | A1 | 6/2006 | Bailly et al. |
| 2007/0068873 | A1 | 3/2007 | Oroskar et al. |
| 2007/0148315 | A1 | 6/2007 | Schaap et al. |
| 2007/0158270 | A1 | 7/2007 | Geier et al. |
| 2007/0181504 | A1 | 8/2007 | Binder et al. |
| 2008/0234375 | A1 | 9/2008 | Breivik et al. |
| 2009/0023808 | A1 | 1/2009 | Raman et al. |
| 2009/0176284 | A1 | 7/2009 | Furihata et al. |
| 2010/0012584 | A1 | 1/2010 | Majewski et al. |
| 2010/0069492 | A1 | 3/2010 | Geiringen et al. |
| 2010/0104657 | A1 | 4/2010 | Sondbo et al. |
| 2010/0160435 | A1 | 6/2010 | Bruzzese |
| 2010/0163490 | A1 | 7/2010 | Lasalle |
| 2010/0186587 | A1 | 7/2010 | Kessler et al. |
| 2010/0190220 | A1 | 7/2010 | Furihata et al. |
| 2010/0197785 | A1 | 8/2010 | Breivik |
| 2010/0233281 | A1 | 9/2010 | Breivik et al. |
| 2010/0267829 | A1 | 10/2010 | Breivik et al. |
| 2010/0331559 | A1 | 12/2010 | Feist et al. |
| 2010/0331561 | A1 | 12/2010 | Schaap et al. |
| 2011/0000853 | A1 | 1/2011 | Valery et al. |
| 2011/0015418 | A1 | 1/2011 | Krumbholz et al. |
| 2011/0030457 | A1 | 2/2011 | Valery et al. |
| 2011/0091947 | A1 | 4/2011 | Kim et al. |
| 2011/0139001 | A1 | 6/2011 | Hilaireau et al. |
| 2011/0168632 | A1 | 7/2011 | Valery et al. |
| 2012/0214966 | A1 | 8/2012 | Theoleyre et al. |
| 2012/0232141 | A1 | 9/2012 | Hustvedt et al. |
| 2012/0330043 | A1 | 12/2012 | Kelliher et al. |

FOREIGN PATENT DOCUMENTS

| | | | |
|---|---|---|---|
| EP | 0255824 AO | A1 | 2/1988 |
| EP | 0342629 | B1 | 8/1993 |
| EP | 0697034 AO | A1 | 2/1996 |
| EP | 0981399 AO | A1 | 3/2000 |
| EP | 1106602 | A1 | 6/2001 |
| EP | 1128881 AO | A1 | 9/2001 |
| EP | 1152755 AO | A1 | 11/2001 |
| EP | 1157692 | A1 | 11/2001 |
| EP | 1166840 | A1 | 1/2002 |
| EP | 1250058 AO | A1 | 10/2002 |
| EP | 1250059 AO | A2 | 10/2002 |
| EP | 1392411 AO | A1 | 3/2004 |
| EP | 1436370 AO | A1 | 7/2004 |
| EP | 1523541 AO | A1 | 4/2005 |
| EP | 1534807 AO | A1 | 6/2005 |
| EP | 1685222 AO | A1 | 8/2006 |
| EP | 1749079 AO | A1 | 2/2007 |
| EP | 1982752 | A1 | 10/2008 |
| EP | 2169038 | A1 | 3/2010 |
| EP | 2173184 AO | A1 | 4/2010 |
| EP | 2173699 AO | A1 | 4/2010 |
| EP | 2295529 | A2 | 3/2011 |
| FR | 2103302 | A5 | 4/1972 |
| FR | 2651148 | A1 | 3/1991 |
| FR | 2651149 | A1 | 3/1991 |
| FR | 2785196 | A1 | 5/2000 |
| FR | 2889077 | A1 | 2/2007 |
| FR | 2897238 | A1 | 8/2007 |
| GB | 2221843 | A | 2/1990 |
| HK | 1078509 | A1 | 6/2006 |
| JP | 5888339 | A | 5/1983 |

(56) References Cited

FOREIGN PATENT DOCUMENTS

| | | | |
|---|---|---|---|
| JP | 58109444 | A | 6/1983 |
| JP | 60197209 | A | 10/1985 |
| JP | 61-192797 | A | 8/1986 |
| JP | 05168434 | A | 7/1993 |
| JP | 05171177 | A | 7/1993 |
| JP | 06287594 | A | 10/1994 |
| JP | 08218091 | A | 8/1996 |
| JP | 08512336 | A | 12/1996 |
| JP | 09157684 | A | 6/1997 |
| JP | 11-57302 | A | 3/1999 |
| JP | 11-90105 | A | 4/1999 |
| JP | 2001139981 | A | 5/2001 |
| JP | 2010530068 | A | 9/2010 |
| SI | 1797021 | T1 | 4/2009 |
| WO | 1987/03899 | A1 | 7/1987 |
| WO | 94/25552 | A1 | 11/1994 |
| WO | 98/32514 | A1 | 7/1998 |
| WO | 98/51391 | A1 | 11/1998 |
| WO | 99/47228 | A1 | 9/1999 |
| WO | 00/25885 | A1 | 5/2000 |
| WO | 00/48592 | A1 | 8/2000 |
| WO | 01/50880 | A2 | 7/2001 |
| WO | 01/50884 | A1 | 7/2001 |
| WO | 01/87924 | A2 | 11/2001 |
| WO | 2001/87451 | A2 | 11/2001 |
| WO | WO 01/87452 | | 11/2001 |
| WO | 02/089946 | A1 | 11/2002 |
| WO | 03/033631 | A1 | 4/2003 |
| WO | 20041007654 | A1 | 1/2004 |
| WO | 20041007655 | A1 | 1/2004 |
| WO | 20051049772 | A1 | 6/2005 |
| WO | 20051100519 | A1 | 10/2005 |
| WO | 20071012750 | A2 | 2/2007 |
| WO | 20071017240 | A2 | 2/2007 |
| WO | 20071038417 | A2 | 4/2007 |
| WO | WO 2007/075499 | | 7/2007 |
| WO | 20071093690 | A1 | 8/2007 |
| WO | 20071147554 | A2 | 12/2007 |
| WO | 20081004900 | A1 | 1/2008 |
| WO | 20081107562 | A2 | 9/2008 |
| WO | 2008/149177 | A2 | 12/2008 |
| WO | 20091006317 | A1 | 1/2009 |
| WO | 20091014452 | A1 | 1/2009 |
| WO | 2009/047408 | A1 | 4/2009 |
| WO | 2009/105351 | A1 | 8/2009 |
| WO | 20101018423 | A1 | 2/2010 |
| WO | 2010/119319 | A1 | 10/2010 |
| WO | WO 2011/080503 | | 7/2011 |
| WO | 2013/005046 | A1 | 1/2013 |
| WO | 2013/005047 | A1 | 1/2013 |
| WO | WO 2013/005048 | | 1/2013 |
| WO | WO 2013/005051 | | 1/2013 |
| WO | WO 2013/005052 | | 1/2013 |
| ZA | 8905758 | A | 4/1990 |

OTHER PUBLICATIONS

Beebe, Janet M., et al., "Preparative-Scale High-Performance Liquid Chromatography of Omega-3 Polyunsaturated Fatty Acid Esters Derived From Fish Oil," Journal of Chromatography, vol. 459, pp. 369-378 (1988).

Guiochon, et al., "Chapter 17.8.5 Multicomponent Separations in SMB," Fundamentals of Preparative and Non-Linear Chromatography, 2nd Ed., pp. 833-835 (2006).

Hidajat, K., et al., "Preparative-scale liquid chromatographic separation of ω-3 fatty acids from fish oil sources," Journal of Chromatography A, vol. 702, pp. 215-221 (1995).

Kim, Jeung Kun, et al., "Designs of Simulated-Moving-Bed Cascades for Quaternary Separations," Ind. Eng. Chem. Res., vol. 43, pp. 1071-1080 (2004) (published online Jan. 20, 2004).

Medina, A. Robles, et al., "Concentration and Purification of Stearidonic, Eicosapentaenoic, and Docosahexaenoic Acids from Cod Liver Oil and the Marine Microalga *Isochrysis galbana*," Journal of the American Oil Chemists' Society, vol. 72, No. 5, pp. 575-583 (1995).

Cremasco, M. A., et al.; "Experimental Purification of Paclitaxel From a Complex Mixture of Taxanes Using a Simulated Moving Bed", Brazilian Journal of Chemical Engineering, vol. 26, No. 1, Jan.-Mar., 2009, pp. 207-218.

Dolan, John W.; "Temperature selectivity in reversed-phase high performance liquid chromatography", Journal of Chromatography A., 965, 2002, pp. 195-205.

Heinisch, Sabine, et al.; "Sense and nonsense of high-temperature liquid chromatography", Journal of Chromatography A., 1216, 2009, pp. 642-658.

Hur, Jin Seok, et. al.; "New Design of Simulated Moving Bed (Smb) for Ternary Separations", Ind. Eng. Chem. Res., 44(6), 2005, pp. 1906-1913.

KE8LER, Lars Christian, et al.; "Theoretical study of multicomponent continuous countercurrent chromatography based on connected 4-zone units", Journal of Chromatography a., 1126, 2006, pp. 323-337.

Krzynowek, Judith, et al.; "Purification of Omega - 3 Fatty Acids From Fish Oils Using Hplc: an Overview", Proceedings of the first joint conference of the Tropical and Subtropical Fisheries Technological Society of the Americas with the Atlantic Fisheries Technological Society, 1987, pp. 74-77.

Lee, Chong Ho, et al.; "Designs of simulated moving bed systems with less than N-1 cascades", Theories and Applications of Chem. Eng., vol. 9, No. 2, 2003, pp. 1949-1952.

Lee, Kwangnam, "Two-Section Simulated Moving-Bed Process," Separation Science and Technology, vol. 35, No. 4, pp. 519-534 (2000).

Mun, Sungyong, et al.; "Optimal Design of a Size-Exclusion Tandem Simulated Moving Bed for Insulin Purification", Ind. Eng. Chem. Res., 42(9), 2003, pp. 1977-1993.

Nicolaos, Alexandre, et al.; "Application of equilibrium theory to ternary moving bed configurations (four+four, five+four, eight and nine zones): I. Linear case", Journal of Chromatography A., 908, 2001, pp. 71-86.

Nicolaos, Alexandre, et al.; "Application of the equilibrium theory to ternary moving bed configurations (4+4, 5+4, 8 and 9 zones): Ii. Langmuir case", Journal of Chromatography A., 908, 2001, pp. 87-109.

Nicoud, R. M.; "Chapter 13: Simulated Moving-Bed Chromatography for Biomolecules", Separation Science and Technology, vol. 2, 2000, pp. 475-509.

Nicoud, Roger M.; ''Chapter 1: Simulated Moving Bed (Smb): Some Possible Applications for Biotechnology', Bioseparation and Bioprocessing: A Handbook, vol. I: Biochromatography, Membrane Separations, Modeling, Validation, 1998, pp. 1-39.

Snyder, Lloyd R., et al.; "Chapter 6: Reversed-Phase Chromatography for Neutral Samples," Introduction to Modern Liquid Chromatography, Third Edition, 2010, pp. v-xxix and 253-301.

Szepesy, L., et al.; "Continuous Liquid Chromatography", Journal of Chromatography, 108, 1975, pp. 285-297.

Wolcott, R.G., et al.; "Computer simulation for the convenient optimization of isocratic reversed-phase liquid chromatographic separations by varying temperature and mobile phase strength", Journal of Chromatography A., 869, 2000, pp. 3-25.

Xie, Yi, et al.; "Standing Wave Design and Experimental Validation of a Tandem Simulated Moving Bed Process for Insulin Purification", Biotechnology Progress, 18(6), 2002, pp. 1332-1344.

Yamamura, R., et al.: "Industrial High-Performance Liquid Chromatography Purification of Docosahexaenoic Acid Ethyl Ester and Docosapentaenoic Acid Ethyl Ester from Single-Cell Oil", Journal of the American Oil Chemists' Society, vol. 74, No. 11, Jul. 30, 1997, pp. 1435-1440, XP002166746.

Yoo, Jong Shin, et al.; "Temperature-Programmed Microcolumn Liquid Chromatography/Mass Spectrometry", J. Microcol. Sep., 4(4), Sep. 4, 1992, pp. 349-362.

Zhang, Ziyang, et al., "PowerFeed operation of simulated moving bed units: changing flow-rates during the switching interval," Journal of Chromatography A, vol. 1006, pp. 87-99 (2003).

(56) References Cited

OTHER PUBLICATIONS

Zhu, P. L., et al., "Combined use of temperature and solvent strength in reversed-phase gradient elution I. Predicting separation as a function of temperature and gradient conditions," Journal of Chromatography A, vol. 756, pp. 21-39 (1996).

Zhu, P.L., et al.; "Combined use of temperature and solvent strength in reversed-phase gradient elution: IV. Selectivity for neutral (non-ionized) samples as a function of sample type and other separation conditions", Journal of Chromatography a., 756, 1996, pp. 63-72.

Zhu, Cuiru, et al.; "Elevated Temperature Hplc: Principles and Applications to Small Molecules and Biomolecules", Lcgc Asia Pacific, vol. 8, No. 1, Mar. 2005, pp. 48-59.

Partial European Search Report dated Jan. 7, 2014 issued by the European Patent Office in related European App. No. 13305596.2.

CHROMATOGRAPHIC PROCESS FOR THE PRODUCTION OF HIGHLY PURIFIED POLYUNSATURATED FATTY ACIDS

CROSS-REFERENCE TO RELATED APPLICATIONS

This application claims the benefit of U.S. Provisional Application No. 61/820,459, filed on May 7, 2013. The entire disclosure of the above application is incorporated herein by reference.

TECHNICAL FIELD

The present disclosure relates to a chromatographic process for the production of highly purified polyunsaturated fatty acids and their derivatives.

TECHNICAL BACKGROUND

This section provides background information related to the present disclosure which is not necessarily prior art.

Fatty acids (FAs), and more particularly polyunsaturated fatty acids (PUFAs), as well as their derivatives, are important biological compounds which are components of cellular membranes and which are involved in numerous biological processes, such as the synthesis of hormones (such as prostaglandins) which play a role in platelet aggregation, inflammation, reduction in the triglyceride level, immunological response, etc.

An increasingly large number of drugs based on PUFAs are being developed and commercialized. Some PUFAs have very specific functions. For example:

- Arachidonic acid or ARA (C20 6ω3) is known to be necessary for muscle growth and repair
- Docosahexanoic acid or DHA (C22 6ω3) is known in particular for playing an important role in brain development and neurotransmission.
- Eicosapentaenoic acid or EPA (C20 5ω3) is known for lowering triglycerides. In particular some clinical studies have shown that pure EPA decrease triglycerides levels without raising low density lipoprotein (LDL, so-called "bad") cholesterol levels.
- Docosapentaenoic acid or DPA (C22 5ω3) is known for improving cardiovascular health.

Some other studies have shown that mixtures of EPA and DHA, while lowering triglycerides, increase LDL.

Therefore, it would be desirable to be able to produce compositions comprising EPA, but containing less than 0.5% of DHA, preferably less than 0.05% of DHA, even more preferably having no detectable levels of DHA. Similarly, there is potential interest in producing compositions comprising DHA substantially without ARA, or comprising ARA substantially without DHA, and in general for producing highly purified PUFAs, with compositions which substantially exclude other PUFAs (or other FAs) to enable the development and commercialization of new medicines based on highly purified individual PUFAs having a more controlled efficacy and fewer side effects.

EPA is generally purified from fish oils, algae or yeast for instance. However, fish oil and other biomasses also contain a great number of fatty acids, and in particular large amounts of DHA, that need to be separated from EPA.

DHA may be purified from fish oils, where it is required to separate a large number of other fatty acids including EPA, which is even more abundant than DHA in most oils derived from various fish species. Alternately, DHA may be produced from algae for instance, where ARA is present in sizable quantities, and therefore needs to be separated from ARA. Conversely, when purifying ARA from an algal source, ARA must be separated from DHA.

Methods of production of purified PUFAs are well known by persons skilled in the art. Such purification processes generally include one or more of the following steps: a hydrolysis step to convert triglycerides to free fatty acids or a triglyceride transesterification step to convert fatty acids to alkyl (preferably ethyl) esters, a bleaching step, a urea fractionation step, a molecular distillation step, chromatography steps, and the like. While molecular distillation is a widely used technique to enrich long chain PUFAs, it cannot be used to efficiently separate long-chain PUFAs from each other. Furthermore, PUFAs are very fragile molecules prone to oxidation and degradation. When heated, PUFAs are prone to isomerization, oxidation, peroxidation and oligomerization.

Chromatography processes are efficient means to enrich PUFAs and may be combined with one or more of the purification techniques discussed above. The most widely described chromatography processes are single column chromatography processes, including for example high performance liquid chromatography (HPLC) processes or steady-state recycling chromatography processes, as well as multicolumn chromatography techniques such as simulated moving bed (SMB), VARICOL™ or actual moving bed (AMB) processes as well as other processes known by the person skilled in the art. Since PUFAs are generally produced in very complex mixtures, two or three chromatographic steps are generally required to reach high purities. Some of these processes are described in the following documents: U.S. Pat. No. 5,719,302, US 2011/0091947, WO 2011/080503, WO 2013/005048, WO 2013/005051, WO 2013/005052, each of which is incorporated herein by reference in its entirety.

In some SMB or AMB processes enabling the simultaneous performance of two chromatographic steps, one or several streams containing in particular the target PUFA at intermediate purity may be re-injected to a non-adjacent column of the SMB or AMB apparatus without concentration.

Most chromatography processes involve the use of reversed phase mode, using aqueous organic solvents. Fatty acids, generally in the form of esters, are separated according to their polarity, where the more polar fatty acids elute earlier than the less polar ones, as is well known by those of skill in the art.

One of the main drawbacks of chromatography processes is that they lead to a large dilution of purified fractions. Continuous processes such as SMB, VARICOL™ and AMB may be preferred over batch processes such as HPLC, because they generally lead to more concentrated streams which are referred to as the extract (containing the more retained compounds), and the raffinate (containing the less retained compounds).

Yet, purified and waste fractions produced by chromatographic separation remain very dilute; so that the various collected streams need to be concentrated so as to recover the used eluents (mainly composed of one or more organic solvents and water) and to recycle them in the process, both for economic and environmental reasons.

There is still generally a need for improved processes for the purification of PUFAs to higher degrees of purity with a limited consumption of solvents.

SUMMARY

This section provides a general summary of the disclosure, and is not a comprehensive disclosure of its full scope or all of its features. Specifically disclosed are various embodiments for recovering a polyunsaturated fatty acid from a feed mixture. Processes may optionally include any one or any combination of more than one of the following methods, steps, or features discussed herein.

In certain aspects, the present disclosure provides a process for recovering a first polyunsaturated fatty acid from a feed mixture, where the feed mixture comprises at least a second distinct fatty acid in addition to the first polyunsaturated fatty acid.

The process may optionally comprise:

performing a main step of chromatographic separation using an aqueous organic eluent and thereby collecting a first stream of eluent enriched in the first polyunsaturated fatty acid and a second distinct stream of eluent enriched in the second fatty acid;

subjecting the second stream of eluent to a concentrating step so as to obtain a concentrated portion of the second stream comprising concentrated fatty acids, including the second fatty acid, on the one hand and a depleted portion of the second stream, comprising eluent, but depleted of fatty acids including the second fatty acid on the other hand, where the water-to-organic ratio of the depleted portion of the second stream is lower than the water-to-organic ratio of the second stream of eluent; and at least partially recycling the depleted portion of the second stream for use in the main step of chromatographic separation.

In other aspects, the present disclosure contemplates such a process, where a totality of or completely all of the depleted portion of the second stream is recycled and used in the main step of chromatographic separation.

In yet other aspects, the present disclosure optionally provides a method according to either of those described above, where a debit rate of the depleted portion of the second stream is reduced relative to a debit rate of the second stream of eluent. In certain variations, the reduction is greater than or equal to about 2%, or greater than or equal to about 5%, or greater than or equal to about 10%, and in certain particularly preferred variations, greater than or equal to about 15%, relative to the debit rate of the second stream of eluent.

In certain aspects, the present disclosure optionally provides a method according to any of those described above, where the water-to-organic ratio of the depleted portion of the second stream is less than or equal to about 0.95 times the water-to-organic ratio of the second stream of eluent, optionally less than or equal to about 0.9 times, optionally less than or equal to about 0.8 times, optionally less than or equal to about 0.7 times, optionally less than or equal to about 0.6 times, optionally less than or equal to about 0.5 times, optionally less than or equal to about 0.4 times, optionally less than or equal to about 0.3 times, optionally less than or equal to about 0.2 times, and in certain variations, optionally less than or equal to about 0.1 times the water-to-organic ratio of the second stream of eluent.

In yet other aspects, the present disclosure provides a method according to any of the variations described above, that may further comprise:

subjecting the first stream of eluent to a concentration step so as to obtain a concentrated portion of the first stream of concentrated fatty acids on the one hand and a depleted portion of the first stream comprising eluent on the other hand, and at least partially recycling, and in certain aspects, completely or totally recycling all of, the depleted portion of the first stream, optionally for use in the main step of chromatographic separation.

In yet other aspects, the present disclosure optionally provides a method according to any of those described above, where a debit rate of the depleted portion of the first stream is greater than or equal to about 90%, optionally greater than or equal to about 95%, and in certain particularly preferred variations, optionally greater than or equal to about 98% of a debit rate of the first stream of eluent.

In certain other variations, the present disclosure provides a process that may comprise a single step of separation, namely the main step of chromatographic separation. In certain aspects, the process may thus consist essentially of a single step of separation, namely the main step of chromatographic separation.

In certain aspects, the present disclosure optionally provides a single preliminary step of separation before the main step of chromatographic separation, where the single preliminary step of separation is preferably a preliminary step of chromatographic separation. The single preliminary step of chromatographic separation and the main step of chromatographic separation may be performed either in a same chromatographic unit or in different chromatographic units.

In certain other aspects, the present disclosure provides a method according to any of those described above, which may comprise two preliminary steps of separation before the main step of chromatographic separation. In certain preferred aspects, one of the two preliminary steps of separation is a preliminary step of chromatographic separation. In certain more preferred aspects, both preliminary steps of separation are preliminary steps of chromatographic separation, where each preliminary step of chromatographic separation and the main step of chromatographic separation are performed either in a same chromatographic unit or in different chromatographic units, and the two preliminary steps of chromatographic separation are performed either in a same chromatographic unit or in different chromatographic units.

In yet other aspects, the present disclosure contemplates that part of the depleted portion of the second stream is recycled for use in a preliminary step of separation.

In certain other aspects, the present disclosure optionally provides methods that comprise a single further step of separation after the main step of chromatographic separation. The single further step of separation is preferably a further step of chromatographic separation, where the single further step of chromatographic separation and the main step of chromatographic separation are optionally performed either in a same chromatographic unit or in different chromatographic units.

In yet other aspects, the present disclosure provides a method according to certain variations described above, which comprises two further steps of separation after the main step of chromatographic separation. In certain aspects, one of the two further steps of separation is optionally a further step of chromatographic separation and more preferably both further steps of separation are further steps of chromatographic separation. Each further step of chromatographic separation and the main step of chromatographic separation are optionally performed either in a same chromatographic unit or in different chromatographic units, and the two further steps of chromatographic separation may be performed either in a same chromatographic unit or in different chromatographic units.

In yet other aspects, the present disclosure provides a method according to any of the variations described above that may comprise three or more steps of chromatographic separations, where the steps of chromatographic separations are performed in different chromatographic units or at least in part in a same chromatographic unit. In certain aspects, such a process may comprise the main step of chromatographic separation, a preliminary step of chromatographic separation performed before the main step of chromatographic separation, as well as a further step of chromatographic separation performed after the main step of chromatographic separation.

In other aspects, such a process may comprise two preliminary steps of chromatographic separations, followed by the main step of chromatographic separation. In yet other aspects, such a process may comprise the main step of chromatographic separation, followed by two further steps of chromatographic separation.

In certain variations, a method may consist essentially of three or more of such steps of chromatographic separations. The steps of chromatographic separations are optionally performed in different chromatographic units or at least in part in a same chromatographic unit. In certain aspects, such a process may consist essentially of the main step of chromatographic separation, a preliminary step of chromatographic separation performed before the main step of chromatographic separation, as well as a further step of chromatographic separation performed after the main step of chromatographic separation.

In other aspects, such a process may consist essentially of two preliminary steps of chromatographic separations, followed by the main step of chromatographic separation.

In yet other aspects, such a process may consist essentially of the main step of chromatographic separation, followed by two further steps of chromatographic separation.

In yet other aspects, the present disclosure provides a method according to any of the variations described above that may comprise the feed mixture further comprising at least a third distinct fatty acid. In such variations, the process may comprise:

performing a secondary step of chromatographic separation using an aqueous organic eluent and thereby collecting a third stream of eluent enriched in the first polyunsaturated fatty acid and a fourth stream of eluent enriched in the third fatty acid;

subjecting the third stream of eluent to a concentration step so as to obtain a concentrated portion of the third stream comprising concentrated fatty acids on the one hand and a depleted portion of the third stream on the other hand; and then at least partially recycling, and in certain aspects, completely or totally recycling all of, the depleted portion of the third stream, preferably for use in the secondary step of chromatographic separation; and/or subjecting the fourth stream of eluent to a concentration step so as to obtain a concentrated portion of the fourth stream comprising concentrated fatty acids on the one hand and a depleted portion of the fourth stream on the other hand, the water-to-organic ratio of the depleted portion of the fourth stream being optionally lower than the water-to-organic ratio of the fourth stream of eluent; and then at least partially recycling, and in certain aspects, completely or totally recycling, the depleted portion of the fourth stream, optionally for use in the secondary step of chromatographic separation.

In certain aspects, the above secondary step of chromatographic separation is a preliminary step of chromatographic separation performed before the main step of chromatographic separation; or alternatively the secondary step of chromatographic separation is a further step of chromatographic separation performed after the main step of chromatographic separation.

In other aspects, such a process may further provide that the same aqueous organic eluent is used in the main step of chromatographic separation and in the secondary step of chromatographic separation; or alternatively, different aqueous organic eluents are used in the main step of chromatographic separation and in the secondary step of chromatographic separation; and in certain preferred aspects, the water-to-organic ratio of the aqueous organic eluent used in the main step of chromatographic separation is different from the water-to-organic ratio of the aqueous organic eluent used in the secondary step of chromatographic separation.

In yet other aspects, such processes may optionally further comprise the feed mixture further comprising at least a fourth distinct fatty acid. In certain variations, the process comprises:

performing a tertiary step of chromatographic separation using an aqueous organic eluent and thereby collecting a fifth stream of eluent enriched in the first polyunsaturated fatty acid and a sixth stream of eluent enriched in the fourth fatty acid;

subjecting the fifth stream of eluent to a concentration step so as to obtain a concentrated portion of the fifth stream comprising concentrated fatty acids on the one hand and a depleted portion of the fifth stream on the other hand; and then at least partially recycling, and in certain aspects, completely recycling all of, the depleted portion of the fifth stream, preferably for use in the tertiary step of chromatographic separation; and/or subjecting the sixth stream of eluent to a concentration step so as to obtain a concentrated portion of the sixth stream comprising concentrated fatty acids on the one hand and a portion of the depleted sixth stream on the other hand, the water-to-organic ratio of the depleted portion of the sixth stream being optionally lower than the water-to-organic ratio of the fourth stream of eluent; and then at least partially recycling, and in certain aspects, completely recycling all of, the depleted portion of the sixth stream, preferably to use it in the tertiary step of chromatographic separation.

In certain aspects, the tertiary step of chromatographic separation is a preliminary step of chromatographic separation performed before the main step of chromatographic separation; or the tertiary step of chromatographic separation is a further step of chromatographic separation performed after the main step of chromatographic separation.

In other aspects, such a process may optionally have:

the same aqueous organic eluent that is used in the main step of chromatographic separation and in the tertiary step of chromatographic separation; or where different aqueous organic eluents are used in the main step of chromatographic separation and in the tertiary step of chromatographic separation. In certain preferred variations, the water-to-organic ratio of the aqueous organic eluent used in the main step of chromatographic separation is different from the water-to-organic ratio of the aqueous organic eluent used in the tertiary step of chromatographic separation; and/or the same aqueous organic eluent is used in the secondary step of chromatographic separation and in the tertiary step of chromatographic separation; or where different aqueous organic eluents are used in the secondary step of chromatographic separation and in the tertiary step of chromatographic separation. In certain preferred variations, the water-to-organic ratio of the aqueous organic eluent used in the secondary step of chromatographic separation is different from the water-to-organic ratio of the aqueous organic eluent used in the tertiary step of chromatographic separation.

In yet other aspects, the first polyunsaturated fatty acid is optionally eicosapentaneoic acid, the second fatty acid is optionally docosahexanoic acid or stearidonic acid, and the third and fourth fatty acids are optionally selected from the other of docosahexanoic acid or stearidonic acid, saturated fatty acids and monounsaturated fatty acids.

In certain aspects, the process of any of the above described variations may comprise adding fresh water to the depleted portion of the second stream (comprising eluent) prior to recycling and using it in the main step of chromatographic separation.

In other aspects, a process is contemplated by the present disclosure for recovering a first polyunsaturated fatty acid from a feed mixture, where the feed mixture comprises at least a second fatty acid in addition to the first polyunsaturated fatty acid. Such a process optionally comprises:

performing a main step of chromatographic separation using an aqueous organic eluent and thereby collecting a first stream of eluent enriched in the first polyunsaturated fatty acid and a second stream of eluent enriched in the second fatty acid;

subjecting the second stream of eluent to a concentration step so as to obtain a stream of concentrated fatty acids, including the second fatty acid, on the one hand and a depleted portion of the second stream, comprising eluent but depleted of fatty acids, like the second fatty acid, on the other hand;

where at least part of the depleted portion of the second stream is recycled for use in another process step other than the main step of chromatographic separation.

In certain variations, the other process step may be a step contributing to recovering the first polyunsaturated fatty acid or it may be a step contributing to another purpose, such as the purification or production of another compound. For example, in certain variations, none of the depleted portion of the second stream is recycled for use in the main step of chromatographic separation.

In yet other variations, at least part, and in certain aspects, preferably all, of the depleted portion of the second stream is recycled for use as an eluent in a step of separating a species from another species, preferably a step of chromatographically separating a species from another species, and/or as a fuel, and/or for regenerating a solvent.

In certain aspects, such a process may comprise performing one or more preliminary steps of separation using respective aqueous organic eluents, before the main step of chromatographic separation and/or at least partially recycling the depleted portion of the second stream for use in one or more of the preliminary steps of separation.

In certain aspects, at least one of the preliminary steps of separation is a step of chromatographic separation, and in certain preferred variations, all of the preliminary steps of separation are steps of chromatographic separation.

In other aspects, the process may optionally have substantially all of the depleted portion of the second stream recycled and used in one or more of the preliminary steps of separation.

In certain aspects, the process may further comprise at least one further step of separation after the main step of chromatographic separation, optionally a single further step of separation in certain preferred variations, where the further step(s) of separation are preferably further step(s) of chromatographic separation.

In yet other aspects, part of the depleted portion of the second stream is optionally recycled and used in the main step of chromatographic separation.

In certain variations, the process may comprise a single preliminary step of separation. In certain aspects, such a process may thus consist essentially of a single step of separation, namely the main step of chromatographic separation.

In other variations, the process comprises exactly two preliminary steps of separation. Thus, the process optionally consists essentially of two preliminary steps of separation prior to the main step of chromatographic separation in such an embodiment.

In yet other aspects, the main step of chromatographic separation and at least one preliminary step of chromatographic separation are optionally performed in the same chromatographic unit; and/or the main step of chromatographic separation and at least one further step of chromatographic separation are optionally performed in the same chromatographic unit; and/or all preliminary steps of chromatographic separation, all optional further steps of chromatographic separation and the main step of chromatographic separation are performed in different chromatographic units.

In certain other aspects, the process may optionally further comprise:

subjecting the first stream of eluent to a concentration step so as to obtain a concentrated portion of the first stream of concentrated fatty acids on the one hand and a depleted portion of the first stream of eluent on the other hand, and at least partially recycling, and in certain aspects, completely or totally recycling all of, the depleted portion of the first stream, preferably for use in a step of separation of the process, most preferably the main step of chromatographic separation and/or at least one preliminary step of separation before the main step of chromatographic separation.

In certain aspects, such a process may have a debit rate of the depleted portion of the first stream of eluent of greater than or equal to about 95%, optionally greater than or equal to about 98%, and in certain preferred variations, greater than or equal to about 99% the debit rate of the first stream of eluent.

In certain aspects, the feed mixture further comprises at least a third fatty acid, such that a process optionally comprises:

performing a secondary step of chromatographic separation using an aqueous organic eluent and thereby collecting a third stream of eluent enriched in the first polyunsaturated fatty acid and a fourth stream of eluent enriched in the third fatty acid;

subjecting the third stream of eluent to a concentration step so as to obtain a concentrated portion of the third stream comprising concentrated fatty acids on the one hand and a depleted portion of the third stream of eluent on the other hand; and then at least partially recycling, and in certain aspects, completely or totally recycling all of, the depleted portion of the third stream, optionally to use it in a step of separation of the process, and in certain preferred variations, for use in the secondary step of chromatographic separation; and/or subjecting the fourth stream of eluent to a concentration step so as to obtain a concentrated portion of the fourth stream comprising concentrated fatty acids on the one hand and a depleted portion of the fourth stream on the other hand; and then at least partially recycling, and in certain aspects, completely or totally recycling all of, the depleted portion of the fourth stream of eluent, optionally to use it in a step of separation of the process, and in certain preferred variations, for use in the secondary step of chromatographic separation.

In certain aspects, the secondary step of chromatographic separation is optionally a preliminary step of chromatographic separation performed before the main step of chromatographic separation; or where the secondary step of chromatographic separation is a further step of chromatographic separation performed after the main step of chromatographic separation.

In yet other aspects, the same aqueous organic eluent is used in the main step of chromatographic separation and in the secondary step of chromatographic separation; or different aqueous organic eluents are used in the main step of chromatographic separation and in the secondary step of chromatographic separation; and in certain preferred variations, the water-to-organic ratio of the aqueous organic eluent used in the main step of chromatographic separation is different from the water-to-organic ratio of the aqueous organic eluent used in the secondary step of chromatographic separation.

In certain aspects, the feed mixture may further comprise at least a fourth fatty acid and the process optionally comprises:

performing a tertiary step of chromatographic separation using an aqueous organic eluent and thereby collecting a fifth stream of eluent enriched in the first polyunsaturated fatty acid and a sixth stream of eluent enriched in the fourth fatty acid;

subjecting the fifth stream of eluent to a concentration step so as to obtain a concentrated portion of the fifth stream of concentrated fatty acids on the one hand and a depleted portion of the fifth stream on the other hand; and then at least partially recycling, and in certain aspects, completely or totally recycling all of, the depleted portion of the fifth stream, optionally for use in a step of separation of the process, and in certain variations, for use in the tertiary step of chromatographic separation; and/or subjecting the sixth stream of eluent to a concentration step so as to obtain a concentrated portion of the sixth stream of concentrated fatty acids on the one hand and a depleted portion of the sixth stream on the other hand; and then recycling at least partially, preferably totally, the depleted portion of the sixth stream, optionally for use in a step of separation of the process, and in certain preferred aspects, for use in the tertiary step of chromatographic separation.

In certain aspects, the tertiary step of chromatographic separation is optionally a preliminary step of chromatographic separation performed before the main step of chromatographic separation; or the tertiary step of chromatographic separation is a further step of chromatographic separation performed after the main step of chromatographic separation.

In other aspects, the same aqueous organic eluent may be used in the main step of chromatographic separation and in the tertiary step of chromatographic separation; or different aqueous organic eluents are used in the main step of chromatographic separation and in the tertiary step of chromatographic separation; and in certain preferred variations, the water-to-organic ratio of the aqueous organic eluent used in the main step of chromatographic separation is different from the water-to-organic ratio of the aqueous organic eluent used in the tertiary step of chromatographic separation; and/or the same aqueous organic eluent is used in the secondary step of chromatographic separation and in the tertiary step of chromatographic separation; or different aqueous organic eluents are used in the secondary step of chromatographic separation and in the tertiary step of chromatographic separation; and in certain preferred variations, the water-to-organic ratio of the aqueous organic eluent used in the secondary step of chromatographic separation is different from the water-to-organic ratio of the aqueous organic eluent used in the tertiary step of chromatographic separation.

In certain variations, the first polyunsaturated fatty acid is optionally eicosapentaneoic acid, the second fatty acid is optionally docosahexanoic acid or stearidonic acid, and the third and fourth fatty acids are optionally selected from the other of docosahexanoic acid or stearidonic acid, saturated fatty acids and monounsaturated fatty acids.

In yet other aspects, the present disclosure provides a process for recovering a first polyunsaturated fatty acid from a feed mixture, where the feed mixture comprises at least a second fatty acid in addition to the first polyunsaturated fatty acid. Such a process successively comprises:

performing a main step of chromatographic separation using an aqueous organic eluent, and thereby collecting a first stream of eluent enriched in the first polyunsaturated fatty acid and a second stream of eluent enriched in the second fatty acid;

subjecting the second stream of eluent to a concentration step so as to obtain a concentrated portion of the second stream comprising concentrated fatty acids on the one hand and a depleted portion of the second stream on the other hand, comprising eluent but depleted of fatty acids, wherein a debit rate of the depleted portion of the second stream is reduced relative to a debit rate of the second stream of eluent; and at least partially recycling the depleted portion of the second stream for use in the main step of chromatographic separation.

In certain variations, the reduction or debit rate is greater than or equal to about 2%, or greater than or equal to about 5%, or greater than or equal to about 10%, and in certain particularly preferred variations, greater than or equal to about 15%, relative to the debit rate of the second stream of eluent.

In yet other aspects, a totality of the depleted second stream of eluent is recycled for use in the main step of chromatographic separation.

In certain aspects, the present disclosure optionally provides a method according to any of those described above, where the water-to-organic ratio of the depleted portion of the second stream is less than or equal to about 0.95 times the water-to-organic ratio of the second stream of eluent, optionally less than or equal to about 0.9 times, optionally less than or equal to about 0.8 times, optionally less than or equal to about 0.7 times, optionally less than or equal to about 0.6 times, optionally less than or equal to about 0.5 times, optionally less than or equal to about 0.4 times, optionally less than or equal to about 0.3 times, optionally less than or equal to about 0.2 times, and in certain variations, optionally less than or equal to about 0.1 times the water-to-organic ratio of the second stream of eluent.

In certain other aspects, a process according to any of the variations described above may further comprise:

subjecting the first stream of eluent to a concentration step so as to obtain a concentrated portion of the first stream comprising concentrated fatty acids, including the first polyunsaturated fatty acid, on the one hand and a depleted portion of the first stream on the other hand, comprising eluent, but depleted of fatty acids, and at least partially recycling, and in certain aspects, completely or totally recycling all of, the depleted portion of the first stream, preferably for use in the main step of chromatographic separation.

In certain aspects, such a process may have a debit rate of the depleted portion of the first stream of greater than or equal to about 95%, and in certain preferred variations, greater than or equal to about 98% the debit rate of the first stream of eluent.

In other aspects, the process may comprise a single step of separation, namely the main step of chromatographic separation. In certain aspects, the process may thus consist essentially of a single step of separation, namely the main step of chromatographic separation.

In certain aspects, the process optionally comprises a single preliminary step of separation before the main step of chromatographic separation, where in certain variations, the single preliminary step of separation is preferably a preliminary step of chromatographic separation, where the single preliminary step of chromatographic separation and the main step of chromatographic separation are performed either in a same chromatographic unit or in different chromatographic units.

In yet other aspects, the process optionally comprises two preliminary steps of separation before the main step of chromatographic separation, where preferably one of the two preliminary steps of separation is a preliminary step of chromatographic separation and more preferably both preliminary steps of separation are preliminary steps of chromatographic separation, where each preliminary step of chromatographic separation and the main step of chromatographic separation being performed either in a same chromatographic unit or in different chromatographic units, and the two preliminary steps of chromatographic separation being performed either in a same chromatographic unit or in different chromatographic units.

In certain aspects, part of the depleted portion of the second stream comprising eluent is recycled for use in a preliminary step of separation.

In other aspects, a single further step of separation after the main step of chromatographic separation is conducted, where the single further step of separation is preferably a further step of chromatographic separation, where the single further step of chromatographic separation and the main step of chromatographic separation are performed either in a same chromatographic unit or in different chromatographic units.

In yet other aspects, the process may comprise two further steps of separation after the main step of chromatographic separation, where in certain preferred variations, one of the two further steps of separation is a further step of chromatographic separation and more preferably both further steps of separation are further steps of chromatographic separation. Each further step of chromatographic separation and the main step of chromatographic separation may be performed either in a same chromatographic unit or in different chromatographic units, and the two further steps of chromatographic separation are performed either in a same chromatographic unit or in different chromatographic units.

In yet other aspects, the present disclosure provides a method according to any of the variations described above that may comprise three or more steps of chromatographic separations, where the steps of chromatographic separations are performed in different chromatographic units or at least in part in a same chromatographic unit. In certain variations, a method may consist essentially of three or more of such steps of chromatographic separations.

In certain aspects, such a process may comprise the main step of chromatographic separation, a preliminary step of chromatographic separation performed before the main step of chromatographic separation, as well as a further step of chromatographic separation performed after the main step of chromatographic separation. In certain variations, such a process may comprise two preliminary steps of chromatographic separations, followed by the main step of chromatographic separation. In yet other aspects, such a process may comprise the main step of chromatographic separation, followed by two further steps of chromatographic separation.

In certain aspects, such a process may consist essentially of the main step of chromatographic separation, a preliminary step of chromatographic separation performed before the main step of chromatographic separation, as well as a further step of chromatographic separation performed after the main step of chromatographic separation.

In other aspects, such a process may consist essentially of two preliminary steps of chromatographic separations, followed by the main step of chromatographic separation.

In yet other aspects, such a process may consist essentially of the main step of chromatographic separation, followed by two further steps of chromatographic separation.

In yet other aspects, the present disclosure provides a method according to any of the variations described above, where the feed mixture further comprises at least a third distinct fatty acid. In such variations, the process may comprise:

performing a secondary step of chromatographic separation using an aqueous organic eluent and thereby collecting a third stream of eluent enriched in the first polyunsaturated fatty acid and a fourth stream of eluent enriched in the third fatty acid;

subjecting the third stream of eluent to a concentration step so as to obtain a concentrated portion of the third stream of concentrated fatty acids on the one hand and a depleted portion of the third stream on the other hand; and then at least partially recycling, and in certain aspects, completely or totally recycling all of, the depleted portion of the third stream, preferably for use in the secondary step of chromatographic separation; and/or subjecting the fourth stream of eluent to a concentration step so as to obtain a concentrated portion of the fourth stream of concentrated fatty acids on the one hand and a depleted portion of the fourth stream on the other hand, a debit rate of the depleted portion of the fourth stream being optionally reduced relative to a debit rate of the fourth stream of eluent; and then at least partially recycling, and in certain aspects, completely or totally recycling all of, the depleted portion of the fourth stream, preferably for use in the secondary step of chromatographic separation.

In certain aspects, the secondary step of the chromatographic separation of such a process is optionally a preliminary step of chromatographic separation performed before the main step of chromatographic separation; or alternatively the secondary step of chromatographic separation is a further step of chromatographic separation performed after the main step of chromatographic separation.

In other aspects, such a process may further include the same aqueous organic eluent used in the main step of chromatographic separation and in the secondary step of chromatographic separation; or alternatively, different aqueous organic eluents are used in the main step of chromatographic separation and in the secondary step of chromatographic separation; and in certain preferred aspects, the water-to-organic ratio of the aqueous organic eluent used in the main step of chromatographic separation is different from the water-to-organic ratio of the aqueous organic eluent used in the secondary step of chromatographic separation.

In yet other aspects, such processes may optionally further comprise the feed mixture further comprising at least a fourth distinct fatty acid. In certain variations, the process comprises:

performing a tertiary step of chromatographic separation using an aqueous organic eluent and thereby collecting a fifth stream of eluent enriched in the first polyunsaturated fatty acid and a sixth stream of eluent enriched in the fourth fatty acid;

subjecting the fifth stream of eluent to a concentration step so as to obtain a concentrated portion of the fifth stream of concentrated fatty acids on the one hand and a depleted portion of the fifth stream comprising eluent on the other hand; and then at least partially recycling, and in certain aspects, completely or totally recycling all of, the depleted portion of the fifth stream, preferably for use in the tertiary step of chromatographic separation; and/or subjecting the sixth stream of eluent to a concentration step so as to obtain a concentrated portion of the sixth stream comprising concentrated fatty acids on the one hand and a depleted portion of the sixth stream comprising eluent on the other hand, the debit rate of the depleted portion of the sixth stream being optionally reduced relative to the debit rate of the fourth stream of eluent; and then at least partially recycling, and in certain aspects, completely or totally recycling all of, the depleted portion of the sixth stream, preferably for use in the tertiary step of chromatographic separation.

In certain aspects, the tertiary step of chromatographic separation is a preliminary step of chromatographic separation performed before the main step of chromatographic separation; or the tertiary step of chromatographic separation is a further step of chromatographic separation performed after the main step of chromatographic separation.

In other aspects, such a process may optionally have:

the same aqueous organic eluent is used in the main step of chromatographic separation and in the tertiary step of chromatographic separation; or where different aqueous organic eluent are used in the main step of chromatographic separation and in the tertiary step of chromatographic separation. In certain preferred variations, the water-to-organic ratio of the aqueous organic eluent used in the main step of chromatographic separation is different from the water-to-organic ratio of the aqueous organic eluent used in the tertiary step of chromatographic separation; and/or the same aqueous organic eluent is used in the secondary step of chromatographic separation and in the tertiary step of chromatographic separation; or wherein different aqueous organic eluents are used in the secondary step of chromatographic separation and in the tertiary step of chromatographic separation; and preferably the water-to-organic ratio of the aqueous organic eluent used in the secondary step of chromatographic separation is different from the water-to-organic ratio of the aqueous organic eluent used in the tertiary step of chromatographic separation.

In yet other aspects, the first polyunsaturated fatty acid is optionally eicosapentaneoic acid, the second fatty acid is optionally docosahexanoic acid or stearidonic acid, and the third and fourth fatty acids are optionally selected from the other of docosahexanoic acid or stearidonic acid, saturated fatty acids and monounsaturated fatty acids.

In certain variations, any of the processes described above may include each concentration step being performed in a membrane filtration apparatus, an evaporator, a rectification column, a distillation column, a liquid-liquid extractor or any combination of these apparatuses.

In certain aspects, any of the processes described above are capable of recovering at the end of the process the first polyunsaturated fatty acid in a composition containing less than or equal to about 1 wt. %, optionally less than or equal to about 0.5 wt. %, optionally less than or equal to about 0.1 wt. %, optionally less than or equal to about 0.05 wt. %, optionally less than or equal to about 0.03 wt. %, and in certain preferred variations, optionally less than or equal to about 0.01 wt. % of the second fatty acid relative to the total weight of fatty acids in the composition.

In certain aspects, the first polyunsaturated fatty acid is optionally eicosapentaneoic acid and the second fatty acid is optionally docosahexanoic acid.

In other aspects, the first polyunsaturated fatty acid is optionally docosahexanoic acid and the second fatty acid is optionally eicosapentaneoic acid.

In yet other aspects, the first polyunsaturated fatty acid is optionally eicosapentaneoic acid and the second fatty acid is optionally stearidonic acid.

In certain aspects, the first polyunsaturated fatty acid is docosapentaenoic acid and the second fatty acid is docosahexanoic acid.

In other aspects, the first polyunsaturated fatty acid is optionally docosahexanoic acid and the second fatty acid is optionally docosapentaenoic acid.

In certain other aspects, the first polyunsaturated fatty acid is optionally arichidonic acid and the second fatty acid is optionally docosahexanoic acid.

In certain aspects, the first polyunsaturated fatty acid is optionally docosahexanoic acid and the second fatty acid is optionally arichidonic acid.

In certain variations, the feed mixture that is processed by any of the preceding processes is derived from fish, algae and/or yeast. In certain preferred variations, the feed mixture is derived from fish.

In certain aspects, the present disclosure provides processes that are continuous processes.

In certain variations, at least the main step of chromatographic separation is a simulated moving bed or actual moving bed chromatographic separation process. In certain other variations, preferably all steps of chromatographic separation steps are simulated moving bed or actual moving bed chromatographic separations.

The present disclosure further provides yet another process for recovering a first polyunsaturated fatty acid from a feed mixture, where the feed mixture comprises at least a second fatty acid in addition to the first polyunsaturated fatty acid. Such a process may comprise:

performing a main step of chromatographic separation using an aqueous organic eluent and thereby collecting a first stream of eluent enriched in the first polyunsaturated fatty acid and a second stream of eluent enriched in the second fatty acid;

where at least part of the second stream of eluent is recycled for use as a fuel.

In certain variations, none of the second stream of eluent is recycled for use in the main step of chromatographic separation.

In yet other variations, at least part, and in certain aspects, preferably all, of the second stream of eluent is recycled for use as an eluent in a step of separating a species from another species, preferably a step of chromatographically separating a species from another species, and/or as a fuel, and/or for regenerating a solvent.

It should be noted that when reutilization of the used eluent as fuel is implemented, a concentration step is merely optional. Depending on the composition of the second stream of eluent, direct use (without any further concentrating or processing) of part or all of the second stream of eluent as a fuel is contemplated.

Thus in certain variations, a process is provided for recovering a first polyunsaturated fatty acid from a feed mixture that comprises the first polyunsaturated fatty acid and at least a second fatty acid in addition to the first polyunsaturated fatty acid. The process comprises performing a main step of chromatographic separation using an aqueous organic eluent, and thereby collecting a first stream of eluent enriched in the first polyunsaturated fatty acid and a second stream of eluent enriched in the second fatty acid. The process may further comprise recycling at least part of the second stream of eluent for use as a fuel without any prior concentration step.

In certain aspects, such a process may comprise performing one or more preliminary steps of separation using respective aqueous organic eluents, before the main step of chromatographic separation and/or at least partially recycling the second stream of eluent for use in one or more of the preliminary steps of separation.

In certain aspects, at least one of the preliminary steps of separation is a step of chromatographic separation, and in certain preferred variations, all of the preliminary steps of separation are steps of chromatographic separation.

In other aspects, the process may optionally have substantially all of the second stream of eluent recycled and used in one or more of the preliminary steps of separation.

In certain aspects, the process may further comprise at least one further step of separation after the main step of chromatographic separation, optionally a single further step of separation in certain preferred variations, where the further step(s) of separation are preferably further step(s) of chromatographic separation.

In yet other aspects, part of the second stream of eluent is optionally recycled and used in the main step of chromatographic separation.

In certain variations, the process may comprise a single preliminary step of separation. In certain aspects, the process may thus consist essentially of a single step of separation, namely the main step of chromatographic separation.

In other variations, the process comprises exactly two preliminary steps of separation. Thus, the process optionally consists essentially of two preliminary steps of separation prior to the main step of chromatographic separation in such an embodiment.

In yet other aspects, the main step of chromatographic separation and at least one preliminary step of chromatographic separation are optionally performed in the same chromatographic unit; and/or the main step of chromatographic separation and at least one further step of chromatographic separation are optionally performed in the same chromatographic unit; and/or all preliminary steps of chromatographic separation, all optional further steps of chromatographic separation and the main step of chromatographic separation are performed in different chromatographic units.

In certain other aspects, the process may optionally further comprise:

subjecting the first stream of eluent to a concentration step so as to obtain a concentrated portion of the first stream of concentrated fatty acids on the one hand and a depleted portion of the first stream on the other hand, and at least partially recycling, and in certain aspects, completely or totally recycling all of, the depleted portion of the first stream, preferably for use in a step of separation of the process, most preferably the main step of chromatographic separation and/or at least one preliminary step of separation before the main step of chromatographic separation.

In certain aspects, such a process may have a debit rate of the depleted portion of the first stream of greater than or equal to about 95%, optionally greater than or equal to about 98%, and in certain preferred variations, greater than or equal to about 99% the debit rate of the first stream of eluent.

In certain aspects, the feed mixture further comprises at least a third fatty acid, such that a process optionally comprises:

performing a secondary step of chromatographic separation using an aqueous organic eluent and thereby collecting a third stream of eluent enriched in the first polyunsaturated fatty acid and a fourth stream of eluent enriched in the third fatty acid;

subjecting the third stream of eluent to a concentration step so as to obtain a concentrated portion of the third stream of concentrated fatty acids on the one hand and a depleted portion of the third stream on the other hand; and then at least partially recycling, and in certain aspects, completely or totally recycling all of, the depleted portion of the third stream, optionally for use in a step of separation of the process, and in certain preferred variations, for use in the secondary step of chromatographic separation; and/or subjecting the fourth stream of eluent to a concentration step so as to obtain a concentrated portion of the fourth stream of concentrated fatty acids on the one hand and a depleted portion of the fourth stream on the other hand; and then at least partially recycling, and in certain aspects, completely or totally recycling all of, the depleted portion of the fourth stream, optionally for use in a step of separation of the process, and in certain preferred variations, for use in the secondary step of chromatographic separation.

In certain aspects, the secondary step of chromatographic separation is optionally a preliminary step of chromatographic separation performed before the main step of chromatographic separation; or where the secondary step of chromatographic separation is a further step of chromatographic separation performed after the main step of chromatographic separation.

In yet other aspects, the same aqueous organic eluent is used in the main step of chromatographic separation and in the secondary step of chromatographic separation; or different aqueous organic eluents are used in the main step of chromatographic separation and in the secondary step of chromatographic separation; and in certain preferred variations, the water-to-organic ratio of the aqueous organic eluent used in the main step of chromatographic separation is different from the water-to-organic ratio of the aqueous organic eluent used in the secondary step of chromatographic separation.

In certain aspects, the feed mixture may further comprise at least a fourth fatty acid and the process optionally comprises:

performing a tertiary step of chromatographic separation using an aqueous organic eluent and thereby collecting a fifth stream of eluent enriched in the first polyunsaturated fatty acid and a sixth stream of eluent enriched in the fourth fatty acid;

subjecting the fifth stream of eluent to a concentration step so as to obtain a concentrated portion of the fifth stream of concentrated fatty acids on the one hand and a depleted portion of the fifth stream on the other hand; and then at least partially recycling, and in certain aspects, completely or totally recycling all of, the depleted portion of the fifth stream, optionally for use in a step of separation of the process, and in certain variations, for use in the tertiary step of chromatographic separation; and/or subjecting the sixth stream of eluent to a concentration step so as to obtain a concentrated portion of the sixth stream of concentrated fatty acids on the one hand and a depleted portion of the sixth stream on the other hand; and then recycling at least partly, preferably totally all of, the depleted portion of the sixth stream, optionally for use in a step of separation of the process, and in certain preferred aspects, for use in the tertiary step of chromatographic separation.

In certain aspects, the tertiary step of chromatographic separation is optionally a preliminary step of chromatographic separation performed before the main step of chromatographic separation; or the tertiary step of chromatographic separation is a further step of chromatographic separation performed after the main step of chromatographic separation.

In other aspects, the same aqueous organic eluent may be used in the main step of chromatographic separation and in the tertiary step of chromatographic separation; or different aqueous organic eluents are used in the main step of chromatographic separation and in the tertiary step of chromatographic separation; and in certain preferred variations, the water-to-organic ratio of the aqueous organic eluent used in the main step of chromatographic separation is different from the water-to-organic ratio of the aqueous organic eluent used in the tertiary step of chromatographic separation;

and/or the same aqueous organic eluent is used in the secondary step of chromatographic separation and in the tertiary step of chromatographic separation; or different aqueous organic eluents are used in the secondary step of chromatographic separation and in the tertiary step of chromatographic separation; and in certain preferred variations, the water-to-organic ratio of the aqueous organic eluent used in the secondary step of chromatographic separation is different from the water-to-organic ratio of the aqueous organic eluent used in the tertiary step of chromatographic separation.

In certain variations, the first polyunsaturated fatty acid is optionally eicosapentaneoic acid, the second fatty acid is optionally docosahexanoic acid or stearidonic acid, and the third and fourth fatty acids are optionally selected from the other of docosahexanoic acid or stearidonic acid, saturated fatty acids and monounsaturated fatty acids.

In certain variations, any of the processes described above may each include a concentration step being performed in a membrane filtration apparatus, an evaporator, a rectification column, a distillation column, a liquid-liquid extractor or any combination of these apparatuses.

In certain aspects, any of the processes described above are capable of recovering at the end of the process the first polyunsaturated fatty acid in a composition containing less than or equal to about 1 wt. %, optionally less than or equal to about 0.5 wt. %, optionally less than or equal to about 0.1 wt. %, optionally less than or equal to about 0.05 wt. %, optionally less than or equal to about 0.03 wt. %, and in certain preferred variations, optionally less than or equal to about 0.01 wt. % of the second fatty acid relative to the total weight of fatty acids in the composition.

In certain aspects, the first polyunsaturated fatty acid is optionally eicosapentaneoic acid and the second fatty acid is optionally docosahexanoic acid.

In other aspects, the first polyunsaturated fatty acid is optionally docosahexanoic acid and the second fatty acid is optionally eicosapentaneoic acid.

In yet other aspects, the first polyunsaturated fatty acid is optionally eicosapentaneoic acid and the second fatty acid is optionally stearidonic acid.

In certain aspects, the first polyunsaturated fatty acid is docosapentaenoic acid and the second fatty acid is docosahexanoic acid.

In other aspects, the first polyunsaturated fatty acid is optionally docosahexanoic acid and the second fatty acid is optionally docosapentaenoic acid.

In certain other aspects, the first polyunsaturated fatty acid is optionally arichidonic acid and the second fatty acid is optionally docosahexanoic acid.

In certain aspects, the first polyunsaturated fatty acid is optionally docosahexanoic acid and the second fatty acid is optionally arichidonic acid.

In certain variations, the feed mixture that is processed by any of the preceding processes is derived from fish, algae and/or yeast. In certain preferred variations, the feed mixture is derived from fish.

In certain aspects, the present disclosure provides processes that are continuous processes.

In certain variations, at least the main step of chromatographic separation is a simulated moving bed or actual moving bed chromatographic separation process. In certain other variations, preferably all steps of chromatographic separation steps are simulated moving bed or actual moving bed chromatographic separations.

In various aspects, the present teachings overcome the drawbacks of the prior art. In particular, the present teachings provide improved processes for the purification of PUFAs to higher degrees of purity (such as processes for the purification of very pure DHA, or of very pure EPA) with a limited consumption of solvents.

In certain aspects, the present teachings rely on the surprising finding that, during the concentration of the chromatographic fractions containing undesirable FAs (and in particular undesirable PUFAs) separated from a starting PUFA stream by chromatographic separation, which generally involves the evaporation of the eluent, small but non negligible quantities of such undesirable FAs get entrained into the recycled eluent, thereby contaminating said recycled eluent. As a consequence, the undesirable FAs can contaminate the chromatographic stream containing the desired PUFA, thereby potentially preventing target specifications for undesired FAs (in particular undesirable PUFAs) in the end product or composition from being reached.

Since FAs have very high boiling points, the entrainment of said FAs into the vapor phase at the concentration stage was particularly unexpected. The present inventors have identified that the FAs (notably PUFAs) are particularly entrained with the water component of the water organic eluent.

In certain aspects, the purpose of the present teachings is to reduce or prevent the contamination of the desired PUFA by undesirable FAs upon recycling the eluent(s).

The present teachings provide two analogous solutions to achieve this purpose, both focusing on how to handle the recycling of the eluent recovered from a stream containing at least one undesirable FA which is collected from a chromatographic unit:

In certain aspects, the present disclosure provides a first solution that comprises adjusting the stage of concentrating of the stream comprising the undesirable FA before the recycling of the eluent to the chromatographic unit, in order to reduce or prevent the entrainment of said undesirable FA into the collected eluent. More particularly, the adjustment is performed in such a way that the water-to-organic ratio of the recycled eluent is reduced at the concentration stage (relative to the water-to-organic ratio of the stream collected from the chromatographic unit).

In other aspects, the present disclosure provides a second solution that comprises not recycling (or not totally recycling) the eluent to the chromatographic unit from which said eluent is collected, but rather using recycling the eluent and using it for another purpose, and for instance recycling it to another separation unit which is situated upstream of the chromatographic unit from which the eluent is collected. According to this second solution, no specific step is taken to avoid the entrainment of some undesirable FAs with the recycled eluent at the concentration stage, but the recycled eluent is used in the process in such a way that there is no build-up of undesirable FA in said chromatographic unit.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
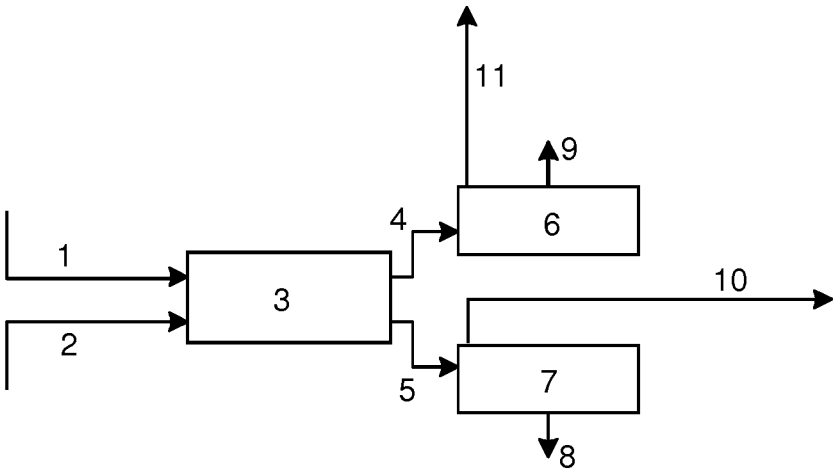
FIG. 1 schematically illustrates an example of coupling a chromatographic step with evaporation and solvent recycling means.

The inventive technology will now be described in more detail without limitation in the following description.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters.

In addition, disclosure of ranges includes disclosure of all values and further divided ranges within the entire range, including endpoints given for the ranges.

As referred to herein, ranges are, unless specified otherwise, inclusive of endpoints and include disclosure of all distinct values and further divided ranges within the entire range. Thus, for example, a range of "from A to B" or "from about A to about B" is inclusive of A and of B. Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

Unless specified otherwise, all concentrations and ratios are expressed by weight.

Example embodiments will now be described more fully with reference to the accompanying drawings.

Outline of the Purification Process

The explanations provided in this section apply both to the first solution and to the second solution according to certain aspects of the present teachings.

In various aspects, the present teachings provide processes for recovering a first (desired) PUFA from a feed mixture. The feed mixture also comprises at least a second (undesirable) FA (preferably a second, undesirable, PUFA), and preferably comprises a number of other (undesirable) FAs, such as saturated or mono-unsaturated fatty acids and other PUFAs as well as potentially other impurities.

The feed mixture can be a mixture of fatty acids, which is derived from fish, algae and/or yeast. In certain preferred variations, the feed mixture is derived from fish. It can be a raw material, such as for instance fish oil, or algal oil. It can also be a product derived from the above raw materials, and for instance derived from fish oil, algal oil or yeast oil. By "product derived from a raw material" is meant a raw material that has been subjected to one or more treatment steps. Said treatment steps can include one or more separation or purification steps (such as a fractionation), and/or a hydrolysis step to convert triglycerides to free fatty acids, and/or a triglyceride transesterification step to convert fatty acids to alkyl (preferably ethyl) esters, and/or a bleaching step, and/or a urea fractionation step, and/or a molecular distillation step, and/or one or more chromatographic separation steps, etc.

Preferably, the feed mixture is a product, which has been esterified, or transesterified, such as a transesterified fish oil, algal oil and/or yeast oil.

Accordingly, each of the fatty acids (and in particular each of the PUFAs) obtained or used in the process of the present teachings can be a fatty acid derivative, notably in the form of a mono-, di- or tri-glyceride, ester, phospholipid, amide, lactone, or salt. Triglycerides and esters are preferred. Esters are more preferred. Esters are typically alkyl esters, preferably C1-C6 alkyl esters, more preferably C1-C4 alkyl esters. Examples of esters include methyl and ethyl esters. Ethyl esters are most preferred.

In various aspects, the process of the present teachings involves one main step of chromatographic separation.

The term "main" in the above expression is used solely to formally distinguish the chromatographic separation at stake from other potential separation steps in the process (which are called preliminary steps of separation, further steps of separation, or secondary or tertiary steps of separation in the present application). It does not necessarily mean that the chromatographic separation at stake is more important, or achieves a larger part of the purification process, or has a higher throughput than other potential separation steps of the process.

In the context of the present application, a chromatographic separation involves the separation of species entrained in a liquid phase, due to different interactions of some of the species with an adsorbent bed.

A chromatographic separation can be a continuous, semi-continuous or batch separation.

Each step of chromatographic separation mentioned in the application is performed in a chromatographic unit. The chromatographic unit used for performing the main step of chromatographic separation is referred to as the main chromatographic unit.

The term "chromatographic unit" designates either a single column chromatography system or a multicolumn chromatography system.

Examples of single column chromatography systems include HPLC or CYCLOJET™ (also referred to as steady-state recycling) systems. Examples of multicolumn column chromatography systems include SMB, iSMB, AMB, VARICOL™, MODICON™, POWERFEED™, MCSGP or GSSR (multicolumn gradient chromatography) systems.

The CYCLOJET™ system is as described in document U.S. Pat. No. 6,063,284, which is incorporated herein by reference in its entirety. It is a single-column, discontinuous chromatographic separation system wherein the separated (i) more retained and then (ii) less retained species are separately collected at the outlet of the column, the non-separated portion of the chromatogram being recycled through the main pump, and the mixture to be separated is periodically injected by means of an injection loop substantially in the middle of the recycled portion of the chromatogram. After several chromatographic cycles, the process reaches a periodical steady-state wherein the quantity of products injected equals the quantity of separated products collected separately at the outlet of the column.

A variant of the CYCLOJET™ system based on two columns is described in document U.S. Pat. No. 5,630,943, which is incorporated herein by reference.

An SMB system is comprised of a number of individual columns containing adsorbent, which are connected together in series. An eluent is passed through the columns in a first direction. The injection points of the feedstock and the eluent, and the separated component collection points in the system, are periodically and simultaneously shifted by means of a series of valves. The overall effect is to simulate the operation of a single column containing a moving bed of the solid adsorbent, the solid adsorbent moving in a countercurrent direction to the flow of eluent. Thus, an SMB system consists of columns that, as in a conventional stationary bed system, contain stationary beds of solid adsorbent through which eluent is passed, but in an SMB system the operation is such as to simulate a continuous countercurrent moving bed.

The most traditional form of SMB system is the four-zone SMB system. Other forms are the three-zone SMB system and the two-zone SMB system (as described in the article Two Section Simulated Moving Bed Process, by Kwangnam Lee, in Separation Science and Technology 35(4):519-534, 2000, incorporated herein by reference in its entirety).

An iSMB system is as described in documents EP 0342629 and U.S. Pat. No. 5,064,539, which are incorporated herein by reference. In an iSMB system, there is one step in which the system operates in a closed loop, without any input/output of material.

Other variants of SMB systems are: the time variable SMB system and POWERFEED™ system, as described in document U.S. Pat. No. 5,102,553 and in the article PowerFeed operation of simulated moving bed units: changing flow-rates during the switching interval, by Zhang et al. in Journal of Chromatography A, 1006:87-99, 2003, both incorporated herein by reference in their respective entireties; the MODICON™ system, as described in document U.S. Pat. No. 7,479,228, incorporated herein by reference in its entirety; and the SMB system with internal recirculation, as described in document U.S. Pat. No. 8,282,831, incorporated herein by reference in its entirety.

An AMB system is similar in operation to an SMB system. However, rather than shifting the injection points of the feed mixture and the eluent, and the separated component collection points by means of a system of valves, instead a series of adsorption units (i.e., columns) are physically moved relative to the feed and draw-off points. Again, operation is such as to simulate a continuous countercurrent moving bed.

A VARICOL™ chromatography system is as described in documents U.S. Pat. No. 6,136,198, U.S. Pat. No. 6,375,839 U.S. Pat. No. 6,413,419 and U.S. Pat. No. 6,712,973, which are incorporated herein by reference in their respective entireties. A VARICOL™ chromatography system is comprised of a number of individual adsorbent-containing columns, which are connected together in series. An eluent is passed through the columns in a first direction. Contrary to the SMB system, the injection points of the feedstock and the eluent, and the separated component collection points in the system are periodically, but asynchronously, shifted by means of a series of valves. The overall effect is to create separation zones of variable length over time, thereby allocating stationary phase dynamically in those zones where it is most needed, and thus enabling similar separation power with less chromatographic units and increasing productivity. Contrary to a SMB system, a VARICOL™ chromatography system does not simulate the operation of a single column containing a moving bed of the solid adsorbent, the solid adsorbent moving in a countercurrent direction to the flow of eluent, and thus the VARICOL™ operational principle cannot be implemented in an equivalent AMB system.

The process according to certain aspects of the present teachings can comprise a single separation step, which is the above-mentioned main step of chromatographic separation.

Alternatively, there can be two separation steps (in total) in the process according to certain aspects of the present teachings, namely the abovementioned main step of chromatographic separation, plus another separation step. According to one embodiment, the other separation step can be performed before the abovementioned main step of chromatographic separation: it can then be referred to as a preliminary step of separation. According to another embodiment, the other separation step can be performed after the abovementioned main step of chromatographic separation: it can then be referred to as a further step of separation.

Alternatively, there can be three separation steps (in total) in a process according to certain aspects of the present teachings, namely the abovementioned main step of chromatographic separation, plus two other separation steps. According to one embodiment, the process comprises the successive steps of (i), a preliminary step of separation, (ii), another preliminary step of separation and (iii), the abovementioned main step of chromatographic separation. According to another embodiment, the process comprises the successive steps of (i), a preliminary step of separation, (ii), the abovementioned main step of chromatographic and (iii), a further step of separation. According to yet another embodiment, the process comprises the successive steps of (i), the abovementioned main step of chromatographic separation, (ii), a further step of separation and (iii), yet a further step of separation.

Alternatively, there can be four separation steps (in total) in certain processes according to the present teachings, or more than four separation steps, one of the separation step being the abovementioned main step of chromatographic separation, and the other separation steps being either preliminary steps of separation (before the abovementioned main step of chromatographic separation) or further steps of separation (after the abovementioned main step of chromatographic separation).

Each step of separation is performed in a separation unit. The preliminary steps of separation are performed in so-called respective preliminary separation units and the further steps of separation are performed in so-called respective further separation units.

Each preliminary step of separation and each further step of separation can be (independently of the other separation steps) a step of chromatographic separation of the same type as described above—the preliminary separation unit or further separation unit being in this case a chromatographic unit as described above.

Alternatively, each preliminary step of separation and each further step of separation can be (independently of the other separation steps) a non-chromatographic step of separation, such as for instance a step of molecular distillation.

According to one embodiment, the process includes two (and only two) successive separation steps, which can be AMB, SMB or VARICOL™ separation steps (one of these two steps being the abovementioned main step of chromatographic separation).

According to another embodiment, the process includes three (and only three) successive separation steps, which can be AMB, SMB or VARICOL™ separations steps (one of these two steps being the abovementioned main step of chromatographic separation).

According to one embodiment, the process includes three (and only three) successive separation steps, namely a (preliminary) VARICOL™ chromatography separation step, followed by the abovementioned main step of chromatographic separation (which can be for instance a CYCLOJET™ separation step or an HPLC separation step), followed by a (further) VARICOL™ chromatography separation step.

According to another embodiment, the process includes three (and only three) successive separation steps, namely a (preliminary) VARICOL™ chromatography separation step, followed by the above-mentioned main step of chromatographic separation (which can be for instance a CYCLOJET™ separation step or an HPLC separation step), followed by a (further) CYCLOJET™ or HPLC separation step.

When the process comprises two or more separation steps, these steps can be conducted simultaneously by using different separation units, or they can be conducted sequentially, by using different separation units or by using the same separation units. In addition, in the case of two separation steps that are chromatographic steps performed in an SMB or AMB system, it is possible to perform these steps simultaneously on a same SMB or AMB system. An example of such simultaneous performance on the same apparatus is described in document WO 2011/080503, which is incorporated herein by reference.

Accordingly, some of the separation units used for implementing the above steps of separation can be the same. For instance, the main chromatographic unit and one preliminary separation unit can be one and the same unit; and/or the main chromatographic unit and one further separation unit can be one and the same unit; and/or one preliminary separation unit and another preliminary separation unit can be one and the same unit; and/or one preliminary separation unit and one further separation unit can be one and the same unit; and/or one further separation unit and another further separation unit can be one and the same unit.

Alternatively, all separation units (including the main chromatographic unit) can be distinct.

Each chromatographic separation step (including the main step of chromatographic separation) can be performed on a reverse phase. For instance, use may be made of adsorbents based on weakly polar resins or silica-based stationary phases chemically modified with organic residues such as alkyl (notably C4, C8, C18, C24, C30), phenyl, or other suitable residues as determined by the skilled in the art.

The main step of chromatographic separation is performed using a water organic eluent. A water organic eluent is a mixture of an organic solvent or several organic solvents and water.

Preferably, if other steps of chromatographic separation are present in the process, they are also performed using respective water organic eluents. Alternatively, other steps of chromatographic separation can be performed using a substantially pure organic solvent or a substantially pure mixture of organic solvents.

By way of non-limiting example, suitable organic solvents which can be used in accordance with the present teachings (notably to form the water organic eluent(s)) are for instance alcohols such as ethanol, propanol, isopropanol and more preferably methanol; ketones such as acetone or methylethyl ketone; nitriles such as acetonitrile; esters such as methylacetate or ethylacetate; furans such as tetrahydrofuran; ethers such as diethylethers or methylethyl ether; and combinations of two or more of the above. In certain aspects, preferred organic solvents are methanol and acetone.

Each water organic eluent is characterized by a water-to-organic ratio, which is the weight ratio of the water component relative to the organic solvent(s) component of the eluent.

The water-to-organic ratio of each water organic eluent can preferably vary between 0.01:99.99 and 30:70, more preferably between 5:95 and 25:75.

When at least two steps of chromatographic separation are present in the process, these steps of chromatographic separation can be performed using eluents having the same composition or different compositions. In certain variations, it is preferred to use eluents having different compositions, and in particular having different water-to-organic ratios, as this makes it possible to adjust the eluting force of the eluent at each separation step and therefore to achieve the separation of different compounds at each step. It may also be preferred to use eluents composed of different organic solvents in the different steps, as this makes it possible to adjust the chromatographic selectivity between certain species to be separated at each separation step and therefore to achieve the separation of different compounds at each step.

The final product obtained owing to the process of the present teachings contains the purified first PUFA, together with residual impurities. The amount of first PUFA in the final product may for example be greater than or equal to about 80%, preferably greater than or equal to about 90%, or greater than or equal to about 95%, or greater than or equal to about 97%, or greater than or equal to about 98%, or in certain variations, optionally greater than or equal to about 99% (relative to the total amount of fatty acids).

In particular, the final product may contain EPA in an amount of greater than or equal to about 80%, or greater than or equal to about 95%, or greater than or equal to about 97%, or greater than or equal to about 98%, or greater than or equal to about 99% (relative to the total amount of fatty acids); as well as DHA in an amount of less than or equal to about 1%, or less than or equal to about 0.1%, or less than or equal to about 0.05%, or less than or equal to about 0.03%, or in certain variations, less than or equal to about 0.01%.

A stabilizer, such as tocopherol or the like, can be added to this final product.

Concentration and Recycling of the Eluent

The explanations provided in this section apply both to the first solution and to the second solution according to certain aspects of the present teachings.

At the outlet of the main chromatographic unit, at least two streams are collected, namely a first stream of eluent enriched in the first (desired) PUFA and a second stream of eluent enriched in the second (undesirable) FA. For instance, the first stream can be a raffinate and the second stream can be an extract, or vice versa.

The process of the present teachings comprises at least one concentration step, which is performed on the second stream, in a concentration unit. This concentration step provides on the one hand a concentrated portion of a stream having concentrated FAs, and on the other hand a depleted portion of a second stream, comprising eluent. The term "depleted" refers to the fact that the second FA (as well as any other fatty acids) has been substantially removed from the eluent. It should also be understood that the expression "stream of concentrated FAs" designates a composition comprising a higher concentration of FAs, and in particular of the second FA, than the second stream of eluent before the concentration step. The composition may comprise other fatty acids, and in particular other undesirable fatty acids, as well as some water and/or solvent.

The depleted portion of the second stream of eluent is then recycled in the process, in a manner which will be detailed below.

The general principle of the concentration and recycling stages after the main step of chromatographic separation can be better understood by making reference to the general scheme in FIG. 1 (the same principle will also apply to concentration and recycling stages performed after other steps of chromatographic separation, such as preliminary or further steps of chromatographic separation, if such concentration and recycling stages are present).

The main chromatographic unit 3 is fed by an incoming eluent stream 1 and by an incoming feed stream 2. The feed stream 2 can be a stream of the (initial) feed mixture if the main step of chromatographic separation is the first step of the process; otherwise, it can be a stream of an intermediate product if one or more treatment steps such as separation steps have already been performed.

At the outlet of the main chromatographic unit 3, a first stream of eluent enriched in first PUFA 4 and a second stream of eluent enriched in second FA 5 are collected.

The first stream of eluent enriched in first PUFA 4 is fed to a first concentration unit 6, while the second stream of eluent enriched in second FA 5 is fed to a second concentration unit 7.

In each concentration unit 6, 7, the eluent is evaporated and then condensed; it is thereby substantially separated from the all fatty acids. Therefore, a stream of concentrated FAs 9 (containing in particular the first PUFA in concentrated form) is obtained at the outlet of the first concentration unit 6 while another concentrated portion of a stream of concentrated FAs 8 (containing in particular the second FA in concentrated form) is obtained at the outlet of the second concentration unit 7. Also, a depleted portion of the first stream 11 comprising eluent (i.e., depleted in first PUFA and other FAs) is recovered at the outlet of the first concentration unit 6, and a depleted portion of the second stream 10 comprising eluent (i.e., depleted in the second FA as well as other FAs) is recovered at the outlet of the second concentration unit 7.

Optionally, the depleted portion of the first stream 11 can be partially or totally recycled to the main chromatographic unit 3 or to any other separation unit used in the process. There is no issue of contamination for this depleted portion of the first stream, since, if the stream is contaminated by any residual PUFA, it will be mainly by the first (desired) PUFA, which will not negatively impact the purity of the final product (first PUFA in purified form).

The depleted portion of the second stream 10 can be partially or totally recycled as well. However, in this case particular steps are taken, according to the present teachings, to avoid negatively impacting the purity of the final product (first PUFA in purified form) due to some residual second (undesirable) FA being entrained into the depleted portion of the second stream of eluent. These particular steps will be detailed below.

The concentration unit used to perform any concentration step can for instance be a falling film evaporator with forced recirculation, a rising evaporator, a flash evaporator, or another type of evaporator known in the art, enabling the evaporation of the eluent components and leaving concentrated fatty acids at the bottom of the device.

Figure 2:
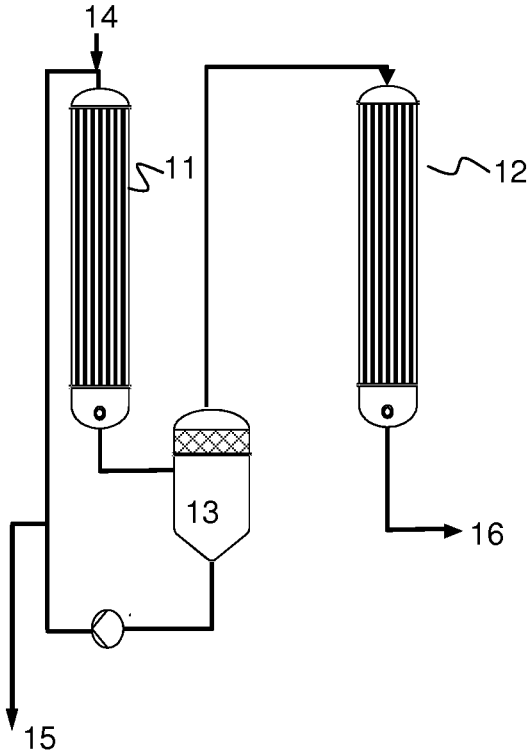
FIG. 2 schematically illustrates an example of implementation of the evaporation of a chromatographic stream, using a falling film evaporator with forced circulation.

Making reference to FIG. 2, according to one embodiment, a concentration unit comprises a multi-tubular evaporator 11 with forced recirculation, connected to a phase separator 13 and to a condenser 12. A stream of eluent 14 to be concentrated is fed to the evaporator 11. The heated stream exits the evaporator 11 and enters the phase separator 13. At the outlet of the phase separator 13, a stream of concentrated FAs 15 is recovered, and the evaporated eluent is collected and passed to the condenser 12. The eluent vapor is condensed to a liquid form in the condenser 12. At the outlet of the condenser 12, the depleted portion of the stream of eluent is collected via a recovery line 16.

Evaporative techniques may be implemented with means known in the art to optimize the level of energy consumption, such as the use of two or more effects, vapor recompression techniques, or for example the use of an evaporated chromatographic stream as a heating fluid for another chromatographic stream.

Figure 3:
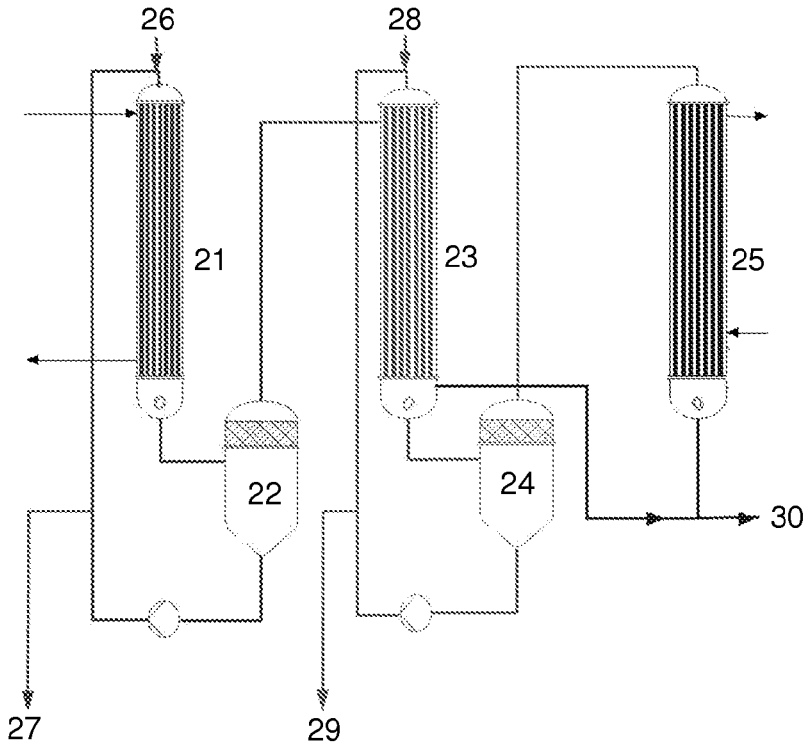
FIG. 3 schematically illustrates an example of implementation of the concentration of a chromatographic stream, in which one of the evaporated streams is used to evaporate a second stream and reduce overall energy consumption.

As an example, reference may be made to FIG. 3. Here, two concentration units are coupled, for example one for treating a first stream of eluent and another one for treating a second stream of eluent (which can e.g., be the same as the first stream eluent and the second stream of eluent defined above, or vice versa). The first concentration unit comprises a first evaporator 21 linked to a first phase separator 22 and to a first condenser 23. The first stream of eluent 26 is fed to the first evaporator 21. A stream of concentrated fatty acids 27 is recovered at the outlet of the first phase separator 22. A vapor phase is also recovered at the outlet of the first phase separator 22 and passed to the first condenser 23.

The second concentration unit comprises a second evaporator 23, which is the same device as the first condenser 23. This second evaporator 23 is linked to a second phase separator 24 and to a second condenser 25. The second stream of eluent 28 is fed to the second evaporator 23. The evaporation of the second stream of eluent 28 is effected (at least partly) owing to the condensation of the vapor phase from the first concentration unit. A stream of concentrated fatty acids 29 is recovered at the outlet of the second phase separator 24. A vapor phase is also recovered at the outlet of the second phase separator 24 and passed to the second condenser 25.

One or two depleted streams of eluent 30 are recovered respectively at the outlet of the first condenser 23 and of the second condenser 25.

Figure 4:
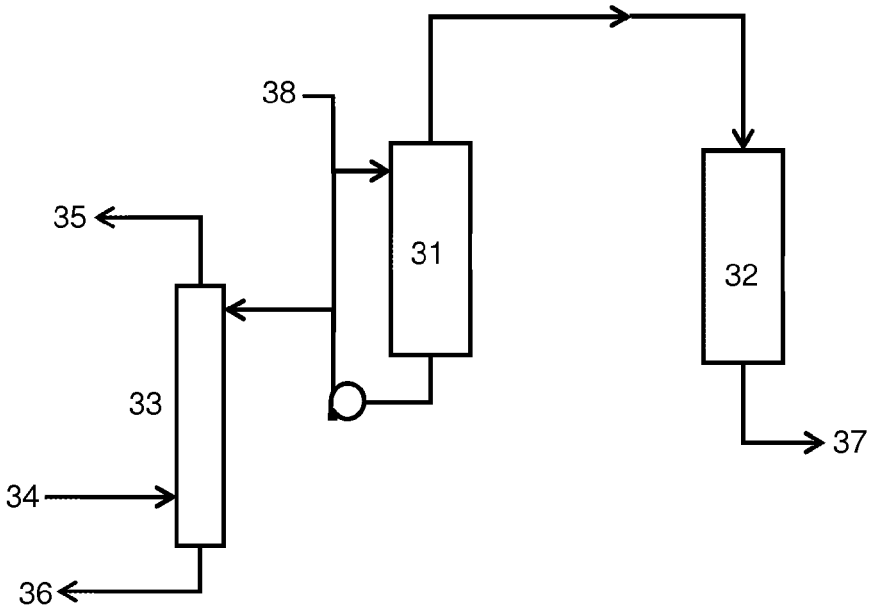
FIG. 4 schematically illustrates an example of implementation of the evaporation of a chromatographic stream, comprising an evaporation stage and a stripping stage.

According to one embodiment, an evaporator with forced circulation may be coupled to a batch or continuous stripping column to remove residual eluent in a stream of concentrated fatty acids. For example, making reference to FIG. 4, a concentration unit may comprise an evaporator 31 coupled on the one hand to a condenser 32 and on the other hand to a stripping column 33. A stream of eluent 38 is fed to the evaporator 31. The vapor phase generated in the evaporator 31 is passed to the condenser 32, and a depleted stream of eluent 37 is recovered at the outlet of the condenser 32. The liquid phase generated in the evaporator 31 is passed to the stripping column 33. A gaseous stream 34 (such as a nitrogen stream) is also fed to the stripping column 33. A stream of concentrated fatty acids 36 as well as a gaseous stream 35 containing residual eluent vapors are collected at respective outlets of the stripping column 33.

Figure 5:
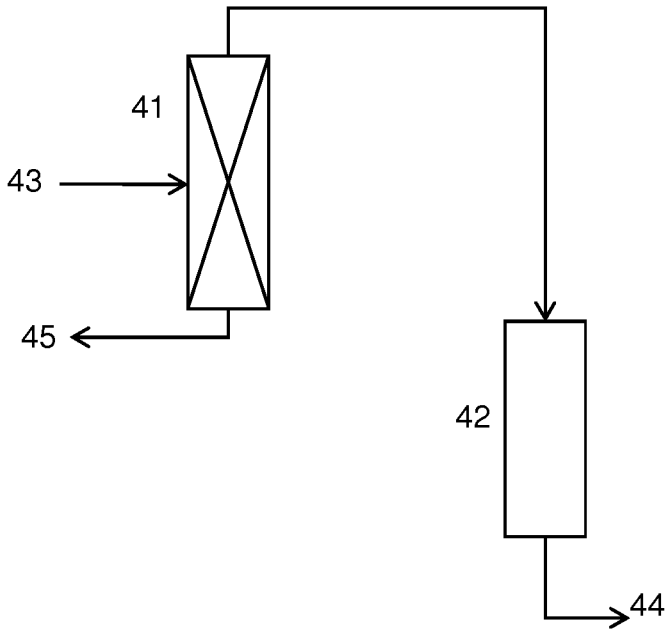
FIG. 5 schematically illustrates an example of implementation of the concentration of a chromatographic stream, comprising a distillation stage.

The concentration step may also comprise a distillation step, in which case the concentration unit comprises at least one distillation column. For example, making reference to FIG. 5, the concentration unit may comprise a distillation column 41 coupled to a condenser 42. A stream of eluent 43 is fed to the distillation column. A vapor phase is recovered at the top of the column and passed to the condenser 42. A depleted stream of eluent 44 is collected at the outlet of the condenser 42. A stream of concentrated fatty acids 45 is collected at the bottom of the distillation column 41.

Figure 6:
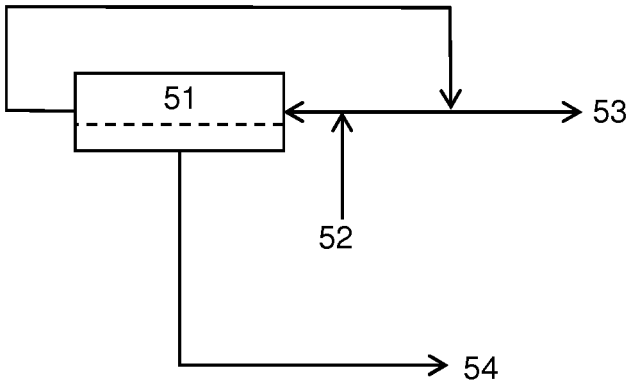
FIG. 6 schematically illustrates an example of implementation of the concentration of a chromatographic stream, comprising a nanofiltration stage.

The concentration step may also comprise a membrane filtration step, such as a nanofiltration step. For example, making reference to FIG. 6, the concentration unit may comprise a nanofiltration system 51. A stream of eluent 52 is fed to the nanofiltration system 51. A depleted stream of eluent 54 is recovered as the permeate stream. Part of the retentate stream is recycled to the nanofiltration system 51 and part of it is recovered as a stream of concentrated fatty acids 53.

Figure 7:
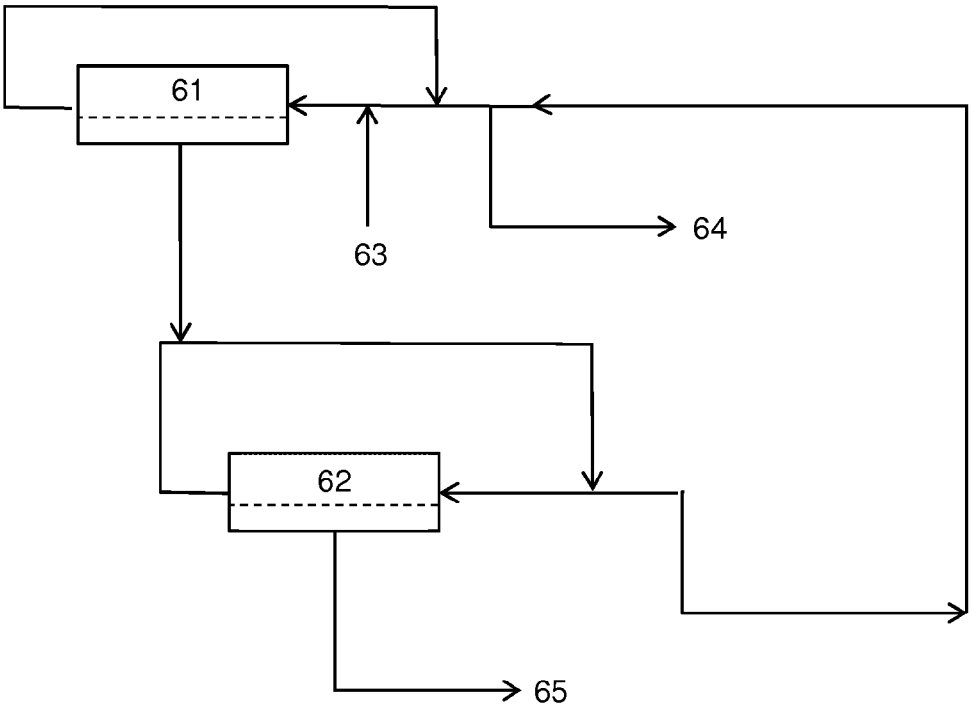
FIG. 7 schematically illustrates an example of implementation of the concentration of a chromatographic stream, comprising two sequential nanofiltration stages.

It is also possible to use two membrane filtration steps in series. For instance, making reference to FIG. 7, the concentration unit may comprise a first nanofiltration system 61 and a second nanofiltration system 62. A stream of eluent 63 is fed to the first nanofiltration system 61. Part of the retentate stream from the first nanofiltration system 61 is recycled to the first nanofiltration system 61 and part of it is recovered as a stream of concentrated fatty acids 64. The permeate stream from the first nanofiltration system 61 is mixed with the retentate stream from the second nanofiltration system 62. Part of this mixed stream is fed to the second nanofiltration system 62 and part of it is mixed with the retentate stream from the first nanofiltration system 61. Finally, a depleted stream of eluent 65 is recovered as the permeate stream from the second nanofiltration system 62.

Figure 8:
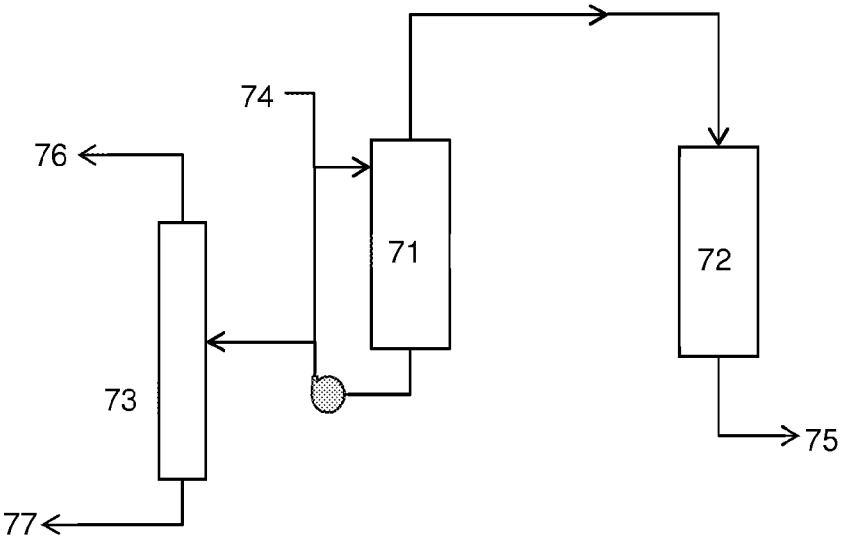
FIG. 8 schematically illustrates an example of implementation of the concentration of a chromatographic stream, comprising a step of liquid-liquid extraction, enabling the separation of concentrated fatty acids from residual water.

It is also possible to provide a liquid-liquid extractor in the concentration unit. For instance, making reference to FIG. 8, the concentration unit may comprise an evaporator 71 coupled to a condenser 72 and a liquid-liquid extractor 73. A stream of eluent 74 is fed to the evaporator 71. The vapor phase from the evaporator 71 is passed to the condenser 72. A depleted stream of eluent 75 is recovered at the outlet of the condenser 72. The liquid phase from the evaporator 71 is partly recycled to the evaporator 71 and partly passed to the liquid-liquid extractor 73. A stream of concentrated fatty acids 76 is recovered at one outlet of the liquid-liquid extractor 73, and a stream of residual water 77 is recovered at the other outlet of the liquid-liquid extractor 73. In an alternate embodiment, the evaporator 71 may be replaced by a distillation column.

Figure 9:
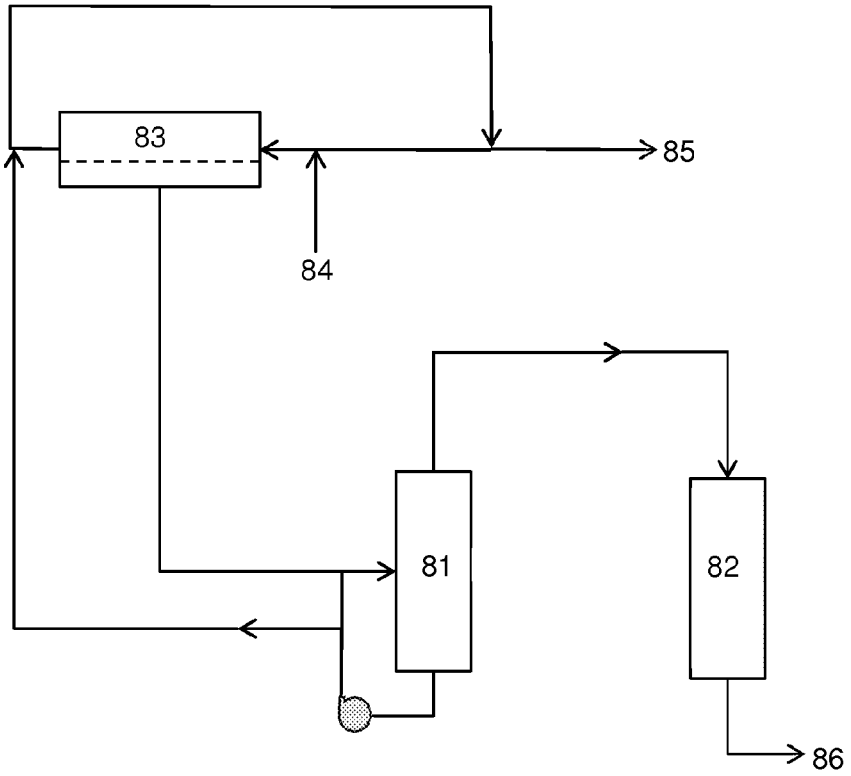
FIG. 9 schematically illustrates an example of implementation of the concentration of a chromatographic stream, comprising an evaporation stage and a nanofiltration stage.

It is also possible to couple a step of membrane filtration, such as nanofiltration, with a step of evaporation. For instance, making reference to FIG. 9, the concentration unit may comprise an evaporator 81 coupled to a condenser 82 and a nanofiltration system 83. A stream of eluent 84 is fed to the nanofiltration system 83. A stream of concentrated fatty acids 85 is recovered as part of the retentate stream from the nanofiltration system 83. The other part of the retentate stream from the nanofiltration system 83 is recycled to the nanofiltration system 83. The permeate stream from the nanofiltration system 83 is passed to the evaporator 81. The vapor phase from the evaporator 81 is passed to the condenser 82. A depleted stream of eluent 86 is recovered at the outlet of the condenser 82. Part of the liquid phase from the evaporator 81 is recycled to the evaporator 81, and part of the liquid phase from the evaporator 81 is mixed with the retentate stream from the nanofiltration system 83.

Figure 10:
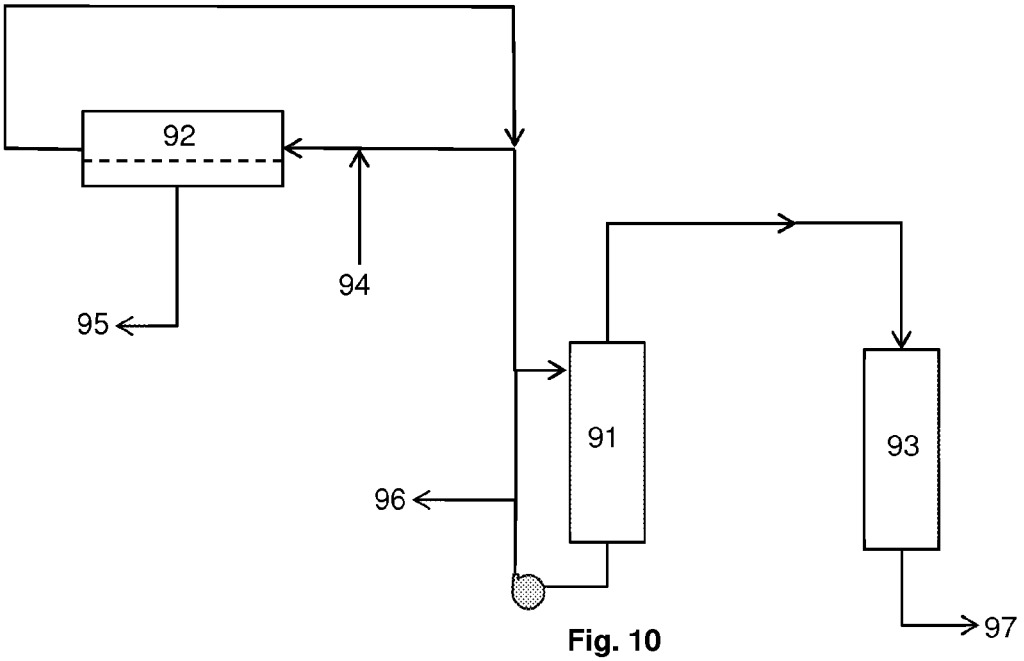
FIG. 10 schematically illustrates an example of implementation of the concentration of a chromatographic stream, allowing a reduced overall energy consumption, comprising an evaporation stage and a nanofiltration stage.

In another example, and making reference to FIG. 10, the concentration unit may comprise an evaporator 91 coupled to a condenser 93 and a nanofiltration system 92. A stream of eluent 94 is fed to the nanofiltration system 92. A depleted stream of eluent 95 is recovered as the permeate stream from the nanofiltration system 92. Part of the retentate stream from the nanofiltration system 92 is recycled to the nanofiltration system 92 and part of it is further concentrated by being passed to the evaporator 91. The vapor phase from the evaporator 91 is passed to the condenser 93. Another depleted stream of eluent 97 is recovered at the outlet of the condenser 93. Part of the liquid phase from the evaporator 91 is recycled to the evaporator 91, and part of it is collected to form a stream of concentrated fatty acids 96.

Variants of Eluent Recycling

In certain variations of the present teachings, a first stream of eluent enriched in the first (desired) PUFA and a second stream of eluent enriched in the second (undesirable) FA are obtained at the main step of chromatographic separation. According to the present teachings, at least the second stream of eluent is concentrated and recycled.

The first stream of eluent may also be concentrated (as shown in FIG. 1) and recycled. At least 90%, preferably at least 99% and even more preferably at least 99.9% of this first stream of eluent can be recycled (notably to the main chromatographic unit), using any of the concentration techniques described above, or any other concentration technique known in the art (in view of the high boiling point of fatty acids such as PUFAs).

Turning now to the concentration and recycling of the second stream of eluent, in certain aspects, the first solution of the present teachings is to perform the concentration step in such a way that the water-to-organic ratio in the depleted portion of the second stream (i.e. after the concentration) is less than the water-to-organic ratio in the second stream of eluent (i.e. before the concentration).

This can be achieved by adjusting the parameters of the concentration stage, since water has a different boiling point from that of the organic solvent(s) present in the eluent. Typically, the evaporation or distillation or other concentration method is performed only partially and not totally, so as to produce a vapor phase which is enriched in organic solvent and depleted in water (as well as in fatty acids) and is then collected to form the depleted portion of the second stream of eluent.

According to one embodiment, the water-to-organic ratio of the depleted portion of the second stream is reduced by greater than or equal to about 1 to less than or equal to about 10% relative to the water-to-organic ratio of the second stream of eluent.

According to one embodiment, the water-to-organic ratio of the depleted portion of the second stream is reduced by greater than or equal to about 10 to less than or equal to about 20% relative to the water-to-organic ratio of the second stream of eluent.

According to one embodiment, the water-to-organic ratio of the depleted portion of the second stream is reduced by greater than or equal to about 20 to less than or equal to about 30% relative to the water-to-organic ratio of the second stream of eluent.

According to one embodiment, the water-to-organic ratio of the depleted portion of the second stream is reduced by greater than or equal to about 30 to less than or equal to about 40% relative to the water-to-organic ratio of the second stream of eluent.

According to one embodiment, the water-to-organic ratio of the depleted portion of the second stream is reduced by greater than or equal to about 40 to less than or equal to about 50% relative to the water-to-organic ratio of the second stream of eluent.

According to one embodiment, the water-to-organic ratio of the depleted portion of the second stream is reduced by greater than or equal to about 50 to less than or equal to about 60% relative to the water-to-organic ratio of the second stream of eluent.

According to one embodiment, the water-to-organic ratio of the depleted portion of the second stream is reduced by greater than or equal to about 60 to less than or equal to about 70% relative to the water-to-organic ratio of the second stream of eluent.

According to one embodiment, the water-to-organic ratio of the depleted portion of the second stream is reduced by greater than or equal to about 70 to less than or equal to about 80% relative to the water-to-organic ratio of the second stream of eluent.

According to one embodiment, the water-to-organic ratio of the depleted portion of the second stream is reduced by greater than or equal to about 80 to less than or equal to about 90% relative to the water-to-organic ratio of the second stream of eluent.

According to one embodiment, the water-to-organic ratio of the depleted portion of the second stream is reduced by greater than or equal to about 90 to less than or equal to about 95% relative to the water-to-organic ratio of the second stream of eluent.

According to one embodiment, the water-to-organic ratio of the depleted portion of the second stream is reduced by greater than or equal to about 95% relative to the water-to-organic ratio of the second stream of eluent.

According to one embodiment, the depleted portion of the second stream contains less than or equal to about 20% water, optionally less than or equal to about 10% water, preferably less than or equal to about 5% water, or less than or equal to about 2% water, or less than or equal to about 1% water, or less than or equal to about 0.5% water, or less than or equal to about 0.1% water, or less than or equal to about 0.05% water, or less than or equal to about 0.01%, or less than or equal to about 0.005% water, or less than or equal to about 0.001% water.

According to one embodiment, the debit rate of the depleted portion of the second stream is reduced by greater than or equal to about 1 to less than or equal to about 5% relative to the debit rate of the second stream of eluent.

According to one embodiment, the debit rate of the depleted portion of the second stream is reduced by greater than or equal to about 5 to less than or equal to about 10% relative to the debit rate of the second stream of eluent.

According to one embodiment, the debit rate of the depleted portion of the second stream is reduced by greater than or equal to about 10 to less than or equal to about 20% relative to the debit rate of the second stream of eluent.

According to one embodiment, the debit rate of the depleted portion of the second stream is reduced by greater than or equal to about 20 to less than or equal to about 30% relative to the debit rate of the second stream of eluent.

According to one embodiment, the debit rate of the depleted portion of the second stream is reduced by greater than or equal to about 30 to less than or equal to about 40% relative to the debit rate of the second stream of eluent.

According to one embodiment, the debit rate of the depleted portion of the second stream is reduced by greater than or equal to about 40 to less than or equal to about 50% relative to the debit rate of the second stream of eluent.

According to one embodiment, the debit rate of the depleted portion of the second stream is reduced by greater than or equal to about 50% relative to the debit rate of the second stream of eluent.

The depleted portion of the second stream comprising eluent, owing to the reduction in its water-to-organic ratio relative to the second stream of eluent, contains a minimal or low level of entrained undesirable second FA, and preferably no entrained undesirable second FA. This depleted portion of the second stream of eluent can thus be recycled in part, or preferably totally, to the main chromatographic unit, for implementing the main step of chromatographic separation.

A make-up of (fresh) water may be provided in order to compensate for the depletion in water. Such addition of water may take place anywhere between the concentration step and the return of the stream to the main chromatographic unit. It may in particular take place before the depleted portion of the second stream in vapor form is condensed, or, preferably, after it is condensed.

The addition of water may bring the water-to-organic ratio of the stream back to the original value before the concentration step, or it may bring it to a different value.

An optional make-up of (fresh) organic solvent(s) may be provided as well.

The depleted portion of the second stream may be subjected to other sorts of treatment before being recycled and used in the main step of chromatographic separation.

The second solution according to certain aspects of the present teachings, whether the water-to-organic ratio of the depleted portion of the second stream is identical or not to the water-to-organic ratio of the second stream of eluent, consists in not recycling all of the depleted portion of the second stream to use it in the main chromatographic unit. According to this second solution, at least part of the depleted portion of the second stream is recycled to be used in another process step, for instance either as an eluent or as a fuel.

Thereby, the potentially entrained undesirable second FA does not compromise the efficiency of the main step of chromatographic separation, while the global cost of the operation of the plant is nevertheless not substantially increased.

It is still possible to recycle part of the depleted portion of the second stream comprising eluent for use in the main step of chromatographic separation, provided that the proportion of depleted portion of the second stream which is recycled in this way remains below a certain threshold so that the level of contamination of the first PUFA by the second FA at the end of the main step of chromatographic separation remains below a certain limit. For instance, between about 0 and about 70%, or between about 0 and about 60%, or between about 0 and about 50%, or between about 0 and about 40%, or between about 0 and about 30%, or between about 0 and about 20%, or between about 0 and about 10% of the depleted portion of the second stream is recycled and used in the main step of chromatographic separation.

According to another embodiment, none of the depleted portion of the second stream is recycled and used in the main step of chromatographic separation. Most preferably, all of the depleted portion of the second stream is recycled and used in another process step.

The depleted portion of the second stream can be recycled and used in another step of the same process, or in a step of a different process, e.g., for producing a different product. This different process can be performed in the same installation or in a different installation (in which case the depleted second stream of eluent is stored and transported from one installation to the other).

For instance, the depleted portion of the second stream can be used to regenerate pure organic solvent from the stream in the same installation or in a remote location. In certain aspects, such pure organic solvent is used partly or totally to feed the main chromatographic step, so that the overall cost of the process is not substantially affected.

According to a preferred embodiment, the process of the present teachings comprises recycling part or all of the depleted portion of the second stream comprising eluent to another separation unit upstream of the main chromatographic unit (to implement a preliminary separation step performed before the main step of chromatographic separation).

It should be noted that when reutilization of the used eluent as fuel is implemented, the concentration step becomes optional. Depending on the composition of the second stream of eluent, it may be possible to directly use part or all of it as a fuel without producing first a depleted second stream of eluent containing less fatty acids (or water).

Figure 11:
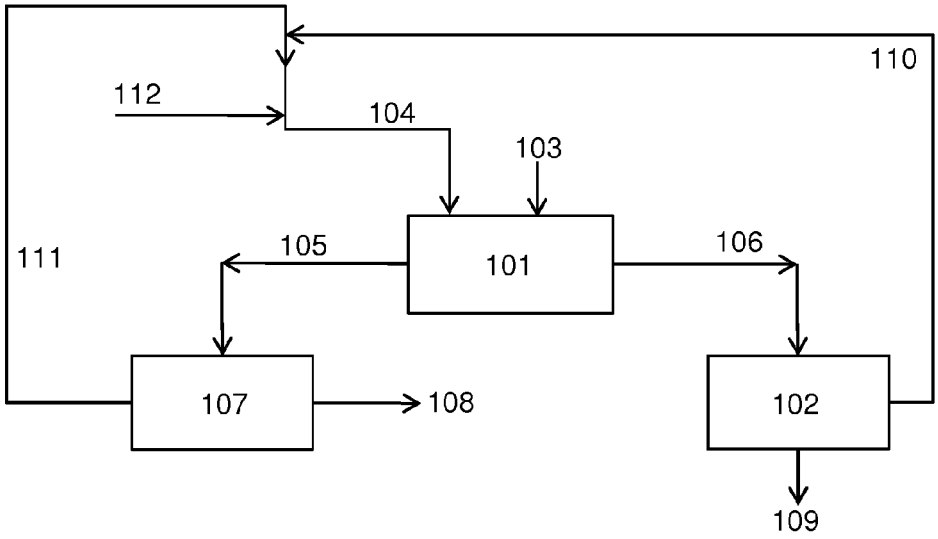
FIG. 11 schematically illustrates an example of implementation of a first solution according to certain aspects of the present teachings.

According to one embodiment which implements the first solution according to certain aspects of the present teachings, and making reference to FIG. 11, the process comprises a main step of chromatographic separation, which comprises treating an incoming stream 103 containing the first (desired) PUFA and the second (undesirable) FA in a main chromatographic unit 101, using a stream of eluent 104. A first stream of eluent 105 enriched in the first PUFA and a second stream of eluent 106 enriched in the second FA are collected at the outlet of the main chromatographic unit 101.

The first stream of eluent 105 is passed to a first concentration unit 107, and the second stream of eluent 106 is passed to a second concentration unit 102.

At the outlet of the first concentration unit 107, a first stream of concentrated fatty acids 108 (containing concentrated first PUFA and possibly further components) and a depleted portion of the first stream of eluent 111 are respectively collected. The depleted portion of the first stream of eluent 111 is recycled to the main chromatographic unit 101. Up to substantially all of the eluent contained in the first stream of eluent 104 can be recycled as the depleted portion of the first stream of eluent 111, and the water-to-organic ratio of the depleted portion of the first stream of eluent 111 can be substantially identical to the water-to-organic ratio of the first stream of eluent 104, since there is no contamination issue.

At the outlet of the second concentration unit 102, a concentrated portion of a second stream of concentrated fatty acids 109 (containing concentrated second FA and possibly further components) and a depleted portion of the second stream 110 are respectively collected. The depleted portion of the second stream of eluent 110 is recycled to the main chromatographic unit 101. The water-to-organic ratio of the depleted portion of the second stream 110 is lower than the water-to-organic ratio of the second stream of eluent 106. Correlatively, the concentrated portion of second stream of concentrated fatty acids 109 contains residual eluent, having a water-to-organic ratio that is greater than the water-to-organic ratio of the second stream of eluent 106. For instance, the concentrated portion of second stream of concentrated fatty acids 109 may contain residual water and substantially no organic solvent.

A make-up of water 112 is provided to compensate for the depletion of the recycled eluent in water. A make-up of organic solvent can be provided as well (not shown).

It should be noted that the incoming stream 103 may be the feed mixture, in case the process comprises one single separation step, or in case the process comprises several separation steps of which the main step of chromatographic separation illustrated here is the first one.

Similarly, the first stream of concentrated fatty acids 108 can be the final product of the process. Or, if the chromatographic separation step illustrated in FIG. 11 is followed by further separation steps, this stream is passed to the next separation stage, in order to separate the first PUFA from other components present in the stream.

Figure 12:
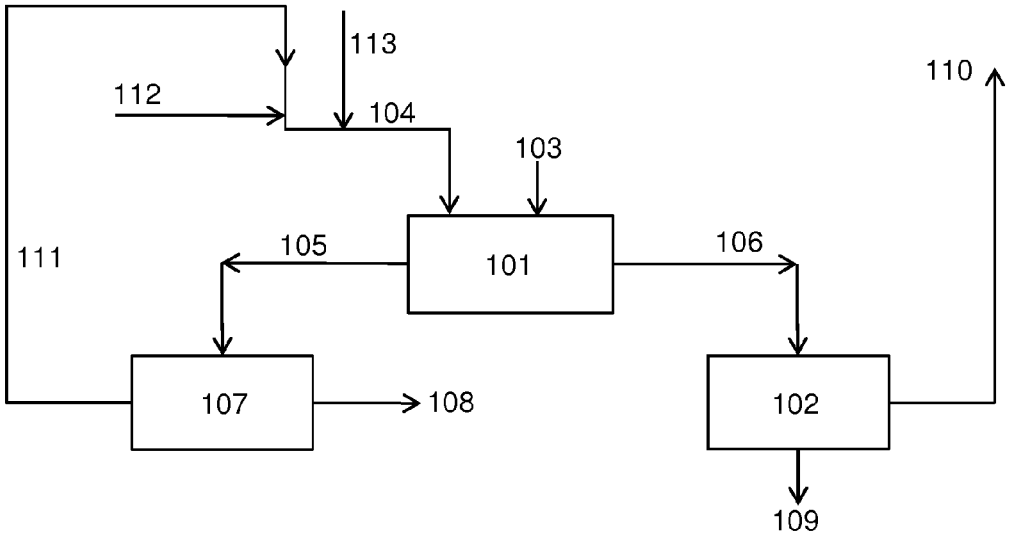
FIG. 12 schematically illustrates an example of implementation of a second solution according to certain aspects of the present teachings.

FIG. 12 illustrates one variant, which implements the second solution according to certain aspects of the present teachings. Numerals similar to those of FIG. 11 have the same meaning. The difference between this variant and the above-described embodiment of FIG. 11 is that the depleted portion of the second stream 110 is not recycled to the main chromatographic unit 101. Instead, this depleted portion of the second stream 110 is recycled to another separation unit upstream of the main chromatographic unit 101 (not shown). In this case, the water-to-organic ratio of the depleted portion of the second stream 110 may be identical (or not) to the water-to-organic ratio of the second stream of eluent 106; and the concentrated portion of second stream of concentrated fatty acids 109 may contain substantially no eluent and in particular no water.

In this variant, the presence of make-up of fresh organic solvent 113 is necessary to compensate for the absence of recycling of the depleted portion of the second stream of eluent 110 to the main chromatographic unit 101. The make-up of water 112 and the make-up of organic solvent 113 can be replaced by a single make-up of eluent.

Figure 13:
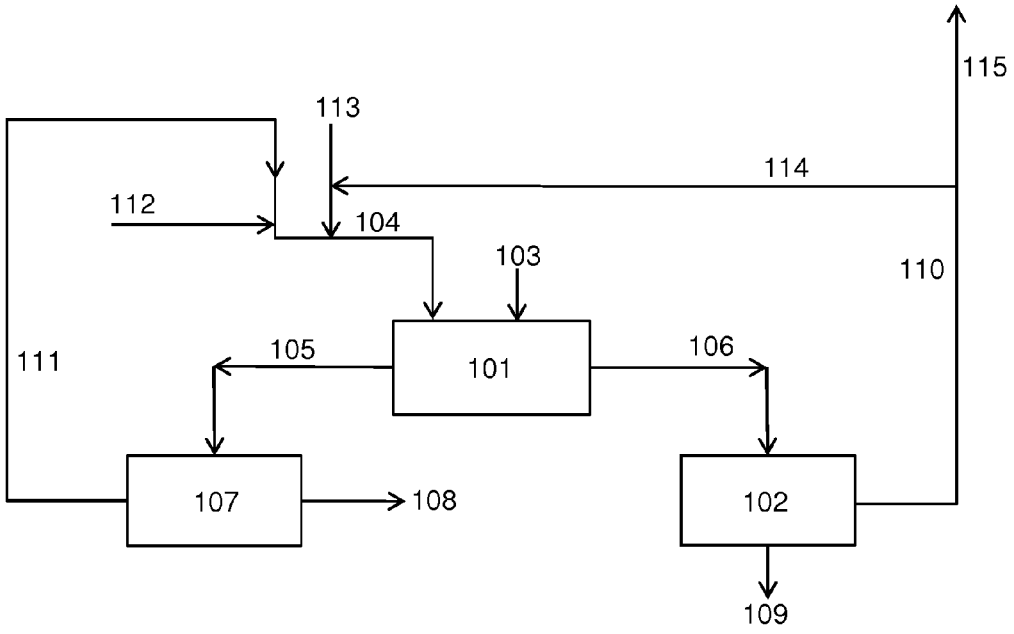
FIG. 13 schematically illustrates another example of implementation of a second solution according to certain aspects of the present teachings.

FIG. 13 illustrates another variant, which implements the second solution according to certain aspects of the present teachings. Numerals similar to those of FIG. 11 have the same meaning. The difference between this variant and the above-described embodiment of FIG. 11 is that the depleted portion of the second stream of eluent 110 is divided into two parts. The first part 114 is recycled to the main chromatographic unit 101, while the second part 115 is not recycled to the main chromatographic unit 101. Instead, this second part 115 is recycled to another separation unit upstream of the main chromatographic unit 101 (not shown). In this case, the water-to-organic ratio of the depleted portion of the second stream of eluent 110 may be identical (or not) to the water-to-organic ratio of the second stream of eluent 106; and the concentrated portion of second stream of concentrated fatty acids 109 may contain substantially no eluent and in particular no water.

In this variant, the presence of make-up of fresh organic solvent 113 is necessary to compensate for the absence of total recycling of the depleted portion of the second stream 110 to the main chromatographic unit 101. The make-up of water 112 and the make-up of organic solvent 113 can be replaced by a single make-up of eluent.

In case the water-to-organic ratio of the depleted portion of the second stream 110 is lower than the water-to-organic ratio of the second stream of eluent 106, this variant is also an embodiment of the first solution according to certain aspects of the present teachings.

It should be noted that the depleted portion of the second stream of eluent can be recycled to a pool of eluent that feeds several separation units, notably several chromatographic units.

As a very general remark, it should be noted that the process of the present teachings can be implemented in a single installation, or in two or more distinct installations. Any streams described herein can then be stored and transported from one installation to the other so as to enable the process to be performed in its entirety. For instance, the separation unit(s) may be provided in one installation, while the concentration unit(s) (including e.g., one or more distillation columns) can be provided in another, distinct, installation.

The composition of various streams, and in particular the composition of the recycled eluent streams, such as the depleted portion of the second stream, may be analyzed on-line or off-line by adequate methods or devices, and re-adjusted batchwise or continuously using means known in the art.

Preferred Purification Schemes

In a first preferred embodiment according to certain aspects of the present teachings, one or several chromatography steps are used to purify a first PUFA (e.g., EPA) from a mixture of fatty acids. Particularly, the amount of a second FA (e.g., DHA) is desirably reduced in the (final) purified stream containing the first PUFA to less than or equal to about 2%, preferably less than or equal to about 0.5%, preferably less than or equal to about 0.05%, preferably less than or equal to about 0.03%, and even more preferably to non-detectable levels.

At least one of the chromatographic steps is aimed at separating the first PUFA from the second FA and preferably uses a mixture of water and methanol as eluent. The target fraction contains the first PUFA and contains reduced amounts of the second FA. The target fraction collected is concentrated by means of an evaporative or membrane technique such as a nanofiltration system, an evaporator, a distillation column or other appropriate means involving one technique or a combination of techniques known to the man skilled in the art, such that the maximum amount of organic solvent is recycled into the chromatography process.

The preferred evaporative means is a falling film evaporator with forced circulation, operated under reduced pressure. The process also produces at least one waste fraction containing the second FA. In order to recycle the largest portion of eluent from a second stream without entraining the second FA, evaporative means are chosen and evaporation parameters are set such that a significant portion of water remains in the bottoms of the evaporator with the concentrated second FA. As a consequence, the distilled solvent mixture is enriched in the organic solvent compared to water, and the entrainment of the second FA in the solvent vapors is reduced to an acceptable level, enabling the recycling of the distillate in the same chromatographic unit.

Preferred means include a distillation column or a combination of a distillation column and a falling film evaporator with forced circulation. Alternatively, a membrane technique can be used to concentrate the second FA in the waste stream, and may be coupled with evaporative techniques to recycle a portion of the solvent mixture into the chromatography process.

In a second preferred embodiment according to certain aspects of the present teachings, one or several chromatography steps are used to purify a first PUFA (e.g., EPA) from a mixture of fatty acids. Particularly, the amount of a second FA (e.g., DHA) is desirably reduced in the purified stream containing the first PUFA to less than or equal to about 2%, preferably less than or equal to about 0.5%, preferably less than or equal to about 0.05%, preferably less than or equal to about 0.03%, and even more preferably to non-detectable levels.

At least one of the chromatographic steps is aimed at separating the first PUFA from the second FA and preferably uses a mixture of water and methanol as eluent. The target fraction contains the first PUFA and contains reduced amounts of the second FA. The target fraction is directly re-injected into a subsequent chromatography step to further purify the first PUFA. The process also produces at least one waste fraction containing the second FA.

In order to recycle the largest portion of eluent from a second stream containing the second FA without entraining the second FA, evaporative means are chosen and evaporation parameters are set such that a significant portion of water remains in the bottoms of the evaporator with the concentrated second FA. As a consequence, the distilled solvent mixture is enriched in the organic solvent compared to water, and the entrainment of the second FA in the solvent vapors is reduced to an acceptable level, enabling the recycling of the distillate in the same chromatographic unit.

Preferred means include a combination of a distillation column and a falling film evaporator with forced circulation. Alternately, a membrane technique can be used to concentrate the second FA in the waste stream, and may be coupled with evaporative techniques to recycle a portion of the solvent mixture into the chromatography process.

In a third preferred embodiment according to certain aspects of the present teachings, one or several chromatography steps are used to purify a first PUFA (e.g., EPA) from a mixture of fatty acids. Particularly, the amount of a second FA (e.g., DHA) is desirably reduced in the purified stream containing the first PUFA to less than or equal to about 2%, preferably less than or equal to about 0.5%, preferably less than or equal to about 0.05%, preferably less than or equal to about 0.03%, and even more preferably to non-detectable levels.

At least one of the chromatographic steps is aimed at separating the first PUFA from the second FA and preferably uses a mixture of water and methanol as eluent. The target fraction contains the first PUFA and contains reduced amounts of the second FA.

The target fraction collected is concentrated by means of an evaporative or membrane technique such as a nanofiltration system, an evaporator, a distillation column or other appropriate means involving one technique or a combination of techniques known to those skilled in the art, such that the maximum amount of organic solvent is recycled into the chromatography process. The preferred evaporative means is a falling film evaporator with forced circulation, operated under reduced pressure.

The process also produces at least one waste fraction containing the second FA. Solvent from that waste fraction is not recycled to that chromatographic step aimed at separating the first PUFA from the second FA.

In a fourth preferred embodiment according to certain aspects of the present teachings, one or several chromatography steps are used to purify a first PUFA (e.g., EPA) from a mixture of fatty acids. Particularly, the amount of a second FA (e.g., DHA) is desirably reduced in the purified stream containing the first PUFA to less than or equal to about 2%, preferably less than or equal to about 0.5%, preferably less than or equal to about 0.05%, preferably less than or equal to about 0.03%, and even more preferably to non-detectable levels.

At least one of the chromatographic steps is aimed at separating the first PUFA from the second FA and preferably uses a mixture of water and methanol as eluent. The target fraction contains the first PUFA and contains reduced amounts of the second FA. The target fraction is directly re-injected into a subsequent chromatography step without concentration to further purify the first PUFA. The process also produces at least one waste fraction containing the second FA. Solvent from that waste fraction is not recycled to that chromatographic step aimed at separating the first PUFA from the second FA.

EXAMPLES

The following examples illustrate the present teachings without limitation.

Example 1

A mixture of fatty acid ethyl esters obtained from fish oil (4 g) was dissolved in a 93/7 v/v mixture of methanol (144 g) and water (14.5 g), and then subjected to evaporation in a stirred reactor at 60° C. Two fractions of distillate F1 and F2 with a mass of 33.1 g and 45.1 g respectively were collected during evaporation at 0.6 bar abs, one fraction F3 with a mass of 32.9 g was collected during evaporation at 0.55 bar abs, and one fraction F4 with a mass of 18.9 g was collected during evaporation at 0.05 bar abs. Analysis of the water content and the fatty acid ester content of the evaporated fractions is provided in table 1 below.

TABLE 1 evaporation of a mixture of methanol and water in the presence of a fatty acid ester mixture

| Fraction | Temperature (° C.) | Pressure (bar) | Mass recovered | Water % (w/w) | Fatty acid ester content (ppm) |
|---|---|---|---|---|---|
| F1 | 60 | 0.6 | 33.1 | 1.78 | Not detected |
| F2 | 60 | 0.6 | 45.1 | 3.25 | Not detected |
| F3 | 60 | 0.55 | 32.9 | 5.09 | Not detected |
| F4 | 60 | 0.05 | 18.9 | 19.99 | 27 |
| bottoms | | | 6.4 | 41.26 | Not determined |

Table 1 shows that no detectable amounts of fatty acids are entrained with low amounts of water (less or equal to 5% w/w) in the distillate, and that substantial entrainment (27 ppm) occurs with higher water content in the distillate (20% w/w).

The fatty acid composition of the initial mixture and the fatty acid composition of fraction F4 are analyzed by GC chromatography. The results are provided in Table 2 below.

TABLE 2 composition of entrained fatty acids compared with feed composition before evaporation

| Identification of fatty acids | Retention time (min.) | Initial mixture (surf. %) | Fraction F4 (surf. %) |
|---|---|---|---|
| | 6.904 | 0.29 | |
| C16-0 | 8.985 | 3.11 | 14.65 |
| C16-1 | 9.302 | 1.20 | 4.99 |
| | 10.094 | 0.19 | |
| | 10.17 | 0.21 | |
| | 10.344 | 0.23 | |
| | 10.551 | 0.19 | |
| | 11.097 | 0.16 | |

TABLE 2-continued composition of entrained fatty acids compared with feed composition before evaporation

| Identification of fatty acids | Retention time (min.) | Initial mixture (surf. %) | Fraction F4 (surf. %) |
|---|---|---|---|
| C16-4ω1 | 11.428 | 0.37 | |
| C18-0 | 11.958 | 3.59 | 9.48 |
| C18-1ω9 | 12.267 | 7.23 | 20.32 |
| C18-1ω7 | 12.394 | 2.71 | 7.61 |
| C18-2ω6 | 13.045 | 0.90 | |
| | 13.44 | 0.38 | |
| | 13.548 | 0.19 | |
| C18-3ω3 | 14.238 | 0.63 | |
| C18-4ω3 | 14.793 | 2.51 | 4.59 |
| | 15.037 | 0.20 | |
| | 15.68 | 0.48 | |
| C20-1 | 16.043 | 1.11 | |
| | 16.221 | 0.69 | |
| | 16.578 | 0.25 | |
| | 17.000 | 0.37 | |
| | 17.487 | 0.42 | |
| C20-4ω6 | 17.902 | 2.04 | |
| | 18.36 | 0.19 | |
| C20-4ω3 | 18.896 | 1.67 | |
| | 19.014 | 0.29 | |
| C20-5ω3 (EPA) | 19.39 | 34.12 | 27.97 |
| | 19.874 | 0.21 | |
| | 20.128 | 0.22 | |
| | 20.274 | 0.34 | |
| | 20.485 | 0.28 | |
| C21-5ω3 | 21.671 | 1.88 | |
| | 22.316 | 0.19 | |
| | 22.433 | 0.20 | |
| C22-5ω6 | 22.858 | 0.75 | |
| C22-5ω3 | 23.794 | 4.68 | |
| C22-6ω3 (DHA) | 24.384 | 24.95 | 10.37 |
| | 24.653 | 0.39 | |
| TOTAL | | 100 | 99.98 |

Table 2 shows that the composition of the entrained oil in F4 is enriched in shorter chain fatty acids compared with longer chain fatty acids, demonstrating that a thermodynamic entrainment occurs when increasing amounts of water are evaporated.

Example 2

In this example, a mixture of pre-purified omega-3 PUFAs containing approx. 70% EPA and approximately 10% DHA, was obtained using a VARICOL™ multicolumn chromatography apparatus whose columns were packed with C18 20 μm reversed phase silica, at a total concentration of 62 g/l in a mobile phase containing approximately 90% of acetone and 10% of water (volume per volume). This mixture was concentrated continuously in a single evaporation step using a multi-tube evaporator with forced recirculation as described in FIG. 2:

Dilute PUFA solution flow rate: 96 l/h
Temperature of heating fluid: approx. 100° C.
Temperature of evaporation: approx. 75° C.
Evaporation pressure: approx. 250 mbar
Flow rate of concentrated stream outlet: 6 l/h The PUFA mixture was injected into the evaporation device, comprising the multi-tube evaporator with forced recirculation 11. The concentrated PUFA mixture was collected via line 15, while the evaporated solvents were condensed in the condenser 12 and collected via line 16.

The concentrated PUFA mixture exiting the evaporator contained approx. 0.2% of water and 1% of acetone. The mixture of evaporated solvents recovered in line 16 contained 30 to 100 ppm of fatty acid esters. More than 99% of solvent was recovered and recycled in the same purification step in the process.

Example 3a

In this example, a mixture of pre-purified omega-3 PUFAs containing approx. 70% EPA and approximately 10% DHA was purified using a VARICOL™ multicolumn chromatography apparatus equipped with 5 columns of 20.2 cm internal diameter and 8.5 cm length packed with C18 20 μm reversed phase silica with a mobile phase containing approximately 93% of methanol and 7% of water (volume per volume), and residual amount of DHA in the eluent was approx. 0.1 ppm. Operating conditions were as follows:

Feed rate: 1.5 l/h
Eluent rate: 279 l/h
Extract rate: 226 l/h
Raffinate rate: 54.5 l/h
Operating temperature: 35° C.

The target raffinate stream contained purified EPA at a GC purity of approx. 92% and less than 0.03% DHA, at a total concentration of 19 g/l. This mixture was concentrated continuously in a single continuous evaporator using a multi-tube evaporator with forced recirculation as described in FIG. 2. Operating conditions were as follows:

Dilute PUFA solution flow rate: 54.5 l/h
Temperature of heating fluid: approx. 100° C.
Temperature of evaporation: approx. 75° C.
Evaporation pressure: approx. 250 mbar
Flow rate of concentrated stream outlet: 6 l/h The concentrated PUFA mixture exiting the evaporator contained approx. 0.04% of water and 0.6% of methanol. More than 99% of solvent from the raffinate stream was recovered and was recycled in the same purification step in the process according to certain aspects of the present teachings.

The extract stream containing DHA at a GC purity of approx. 36% and a total fatty acid ester concentration of approx. 1.7 g/l was partially concentrated in a continuous evaporation device similar as the one described in FIG. 2. Operating conditions were as follows:

Dilute PUFA solution flow rate: 226 l/h
Temperature of heating fluid: approx. 100° C.
Temperature of evaporation: approx. 70° C.
Evaporation pressure: approx. 1000 mbar
Flow rate of concentrated stream outlet: 40 l/h The concentrated mixture exiting the evaporator contained approx. 40% water and 60% of methanol. Only approx. 82% of solvent from the extract stream was recovered and was recycled in the same purification step in the process according to certain aspects of the present teachings.

The distilled eluent collected from both extract and raffinate evaporators contained approx. 93.2% of methanol, approx. 12 ppm of fatty acid esters and only 0.1 ppm of DHA, and was recycled in the chromatography process.

Example 3b (Comparative)

In this example, the influence of DHA in the recycled eluent was estimated by computer simulation. A mixture of pre-purified omega-3 PUFAs containing approx. 70% EPA and approximately 10% DHA was purified using a VARICOL™ multicolumn chromatography apparatus equipped with 5 columns of 20.2 cm internal diameter and 8.5 cm length packed with C18 20 μm reversed phase silica with a mobile phase containing approximately 93% of methanol and 7% of water (volume per volume), and DHA in the eluent was approx. 20 ppm. Operating conditions were as follows:

Feed rate: 1.5 l/h
Eluent rate: 279 l/h
Extract rate: 226 l/h
Raffinate rate: 54.5 l/h
Operating temperature: 35° C.

The target raffinate stream contained purified EPA at a GC purity of approx. 92% and approx. 0.12% DHA, at a total concentration of 19 g/l. The impact of 20 ppm of DHA in an eluent stream obtained from complete concentration of both extract and raffinate streams is approx. 0.1% DHA in the purified EPA stream.

What is claimed is:

1. A process for recovering a first polyunsaturated fatty acid from a feed mixture that comprises the first polyunsaturated fatty acid and at least a second fatty acid in addition to the first polyunsaturated fatty acid, the process comprising:

performing a main step of chromatographic separation using an aqueous organic eluent and thereby collecting a first stream of eluent enriched in the first polyunsaturated fatty acid and a second stream of eluent enriched in the second fatty acid;

subjecting the second stream of eluent to a concentration step so as to obtain a concentrated portion of the second stream comprising the second fatty acid and a depleted portion of the second stream comprising the eluent, but depleted of the second fatty acid, wherein the water-to-organic ratio of the depleted portion of the second stream is lower than the water-to-organic ratio of the second stream of eluent; and at least partially recycling the depleted portion of the second stream to use it in the main step of chromatographic separation.

2. The process of claim 1, wherein the water-to-organic ratio of the depleted portion of the second stream is lower than 0.95 times the water-to-organic ratio of the second stream of eluent.

3. The process of claim 1, which comprises a single step of separation, namely the main step of chromatographic separation.

4. The process of claim 1, which comprises a single preliminary step of chromatographic separation before the main step of chromatographic separation.

5. The process of claim 1, which comprises a single further step of chromatographic separation after the main step of chromatographic separation.

6. The process of claim 1, which comprises two further steps of chromatographic separation after the main step of chromatographic separation.

7. The process of claim 1, comprising three or more steps of chromatographic separations.

8. The process of claim 1, which comprises adding fresh water to the depleted portion of the second stream of eluent prior to recycling and using it in the main step of chromatographic separation.

9. The process of claim 1, wherein the first polyunsaturated fatty acid is recovered at the end of the process as a composition containing less than or equal to about 1 wt. % of the second fatty acid relative to the total weight of fatty acids in the composition.

10. The process of claim 1, wherein the first polyunsaturated fatty acid is eicosapentaneoic acid and the second fatty acid is docosahexanoic acid.

11. A process for recovering a first polyunsaturated fatty acid from a feed mixture that comprises the first polyunsaturated fatty acid and at least a second fatty acid in addition to the first polyunsaturated fatty acid, the process comprising:

performing a main step of chromatographic separation using an aqueous organic eluent and thereby collecting a first stream of eluent enriched in the first polyunsaturated fatty acid and a second stream of eluent enriched in the second fatty acid;

subjecting the second stream of eluent to a concentration step so as to obtain a concentrated portion of the second stream comprising the second fatty acid and a depleted portion of the second stream comprising the eluent, but depleted of the second fatty acid;

wherein at least part of the depleted portion of the second stream is recycled for use in another process step other than the main step of chromatographic separation.

12. The process of claim 11, wherein none of the depleted portion of the second stream is recycled for use in the main step of chromatographic separation.

13. The process of claim 11, wherein at least part of the depleted portion of the second stream of eluent is recycled for use as an eluent in a step of separating a species from another species, and/or as a fuel, and/or for regenerating a solvent.

14. The process of claim 11, comprising:

performing one or more preliminary steps of separation using respective aqueous organic eluents, before the main step of chromatographic separation;

at least partially recycling the depleted portion of the second stream to use it in one or more of the preliminary steps of separation.

15. The process of claim 11, comprising at least one further step of chromatographic separation after the main step of chromatographic separation.

16. A process for recovering a first polyunsaturated fatty acid from a feed mixture that comprises the first polyunsaturated fatty acid and at least a second fatty acid in addition to the first polyunsaturated fatty acid, the process comprising:

performing a main step of chromatographic separation using an aqueous organic eluent, and thereby collecting a first stream of eluent enriched in the first polyunsaturated fatty acid and a second stream of eluent enriched in the second fatty acid; and wherein at least part of the second stream of eluent is recycled for use as a fuel.

17. The process of claim 16, wherein the at least part of the second stream of eluent is recycled for use as the fuel without any prior concentration step.

* * * * *

UNITED STATES PATENT AND TRADEMARK OFFICE

CERTIFICATE OF CORRECTION

PATENT NO. : 8,802,880 B1
APPLICATION NO. : 13/897056
DATED : August 12, 2014
INVENTOR(S) : Philippe Adam, Eric Valéry and Jean Bléhaut It is certified that error appears in the above-identified patent and that said Letters Patent is hereby corrected as shown below:

On the Title Page, item (73) Assignee: should read as follows: Groupe Novasep SAS, Pompey (FR)

Signed and Sealed this
Second Day of December, 2014

Michelle K. Lee

Michelle K. Lee
*Deputy Director of the United States Patent and Trademark Office*